US007112130B2

(12) United States Patent
Nishimura et al.

(10) Patent No.: US 7,112,130 B2
(45) Date of Patent: Sep. 26, 2006

(54) COIN CHANGING MACHINE

(75) Inventors: Kazuya Nishimura, Sennan (JP); Hiroaki Yamauchi, Hirakata (JP); Nobuo Takashima, Kashihara (JP)

(73) Assignee: Japan Cash Machine Co., Ltd.

( * ) Notice: Subject to any disclaimer, the term of this patent is extended or adjusted under 35 U.S.C. 154(b) by 18 days.

(21) Appl. No.: 10/526,291

(22) PCT Filed: Sep. 4, 2002

(86) PCT No.: PCT/JP02/08990

§ 371 (c)(1),
(2), (4) Date: Mar. 1, 2005

(87) PCT Pub. No.: WO2004/023404

PCT Pub. Date: Mar. 18, 2004

(65) Prior Publication Data

US 2006/0040603 A1 Feb. 23, 2006

(51) Int. Cl.
*G07D 3/00* (2006.01)
*G07D 9/06* (2006.01)

(52) U.S. Cl. ..... 453/3; 453/61; 453/56; 221/224; 221/259

(58) Field of Classification Search ..... 453/3, 453/61, 63, 56; 198/531, 532, 462.1, 462.2; 221/224, 259; 193/DIG. 1
See application file for complete search history.

(56) References Cited

U.S. PATENT DOCUMENTS 5,722,882 A * 3/1998 Kashiwagi et al. ..... 453/11

FOREIGN PATENT DOCUMENTS

| | | |
|---|---|---|
| JP | 6-19066 | 3/1994 |
| JP | 7-234953 | 9/1995 |
| JP | 2001-43449 | 2/2001 |
| JP | 2001-93020 | 4/2001 |

* cited by examiner

*Primary Examiner*—Eileen D. Lillis
*Assistant Examiner*—Mark J. Beauchaine
(74) *Attorney, Agent, or Firm*—Gerald E. Hespos; Anthony J. Casella

(57) ABSTRACT

Disclosed is a coin change which comprises a coin sort section 50 for sorting coins C discharged from an input hopper 21, and a coin storage section 60 for storing the coins C sorted by the coin sort section 50 on a coin type by type basis. The coin storage section 60 includes a plurality of coin storage grooves 63 provided respectively to the plural coin types and disposed parallel to each other. Each of the coin storage grooves has a width dimension slightly greater than the diameter of a corresponding one of the types of coins and extends approximately horizontally. The coin storage section 60 also includes a stacking belt 65 disposed along the base of each of the coin storage grooves to extend in the longitudinal direction of the coin storage grooves, and a stopper member disposed at the downstream end of each of the coin storage grooves and adapted to be moved between a coin-passing-enabling position of allowing one or more of the coins C to pass therethrough and a stack position preventing the passing of the coins C so as to allow the subsequent coins C to be stacked on each other

4 Claims, 15 Drawing Sheets

COIN CHANGING MACHINE

TECHNICAL FIELD

The present invention relates to a coin change dispenser for use in ejecting a change in coin.

BACKGROUND ART

Heretofore, there has been known a coin change dispenser for use in ejecting a change in coin. This coin change dispenser is designed to transfer toward a coin passage plural types of coins put in an input hopper, to sort the coins into their coin types through a plurality of sorting holes located downstream of the coin passage, and to store the sorted coins in a storage section on a coin type by type basis. Each of the plurality of sorting holes is formed to have a diametral dimension conforming to that of a corresponding one of the types of coins. These sorting holes are serially disposed in ascending order of diametral dimension. The coins transferred to the respective positions of the sorting holes are dropped down through corresponding ones of the sorting holes, and stored in a plurality of storage hoppers provided respectively to the plural coin types. The coin change dispenser is also operable, in response to a request for change, to eject one or more of the coins stored in the storage hoppers in a given amount on a coin type by type basis.

Generally, in the above conventional coin change dispenser, the storage section has a plurality of vertically-extending stacking hoppers provided respectively to the plural coin type so as to sequentially stack coins dropped from corresponding ones of the sorting holes. When the stacking hoppers are used, a coin dropped from one of the sorting hole is received by a corresponding one of the stacking hoppers in such a manner that either one of the top and back surfaces thereof lands thereon, and either one of the top and back surfaces of each of subsequently dropped coins lands on the previously landed coin, so that the coins will be automatically stacked in a superimposed manner.

However, the use of above vertically-long stacking hoppers causes a problem about increase in vertical length or thickness of the coin change dispenser, which hinders downsizing thereof. While it can be contemplated to lay down each of the stacking hoppers and allow coins dropped on the upstream end of the stacking hopper to be sequentially transferred toward the downstream in a standing posture and stacked on each other so as to solve the above problem, this mechanism will raise another problem about difficulties in realizing the structure for transferring the coins in a standing posture due to its complexity.

In view of the above problems, it is therefore an object of the present invention to provide a coin change dispenser capable of stacking and storing sorted coins in a standing posture even in a simplified structure to thereby facilitate downsizing thereof.

DISCLOSURE OF THE INVENTION

The present invention provides a coin change dispenser designed to sequentially extract from an input hopper plural types of coins put in the input hopper, to sort the extracted coins into their coin types, to store the sorted coins on a coin type by type basis, and to eject one or more of the stored coins in a necessary amount on a coin type by type basis in response to a request. The coin change dispenser comprises a sorter for sorting the coins discharged from the input hopper, and a storage device for storing the coins sorted by the sorter. The storage device includes a plurality of coin storage grooves provided respectively to the plural coin types and disposed parallel to each other. Each of the coin storage grooves has a width dimension slightly greater than the diameter of a corresponding one of the types of coins and extends approximately horizontally. The storage device further includes a carrier belt disposed along the base of each of the coin storage grooves to extend in the longitudinal direction of the coin storage grooves, and ejector adapted to be moved between an operation position of allowing one or more of the coins to be ejected from the downstream end of each of the coin storage grooves, and a non-operation position of allowing the coins to be stacked on each other.

According to the present invention, a coin sorted by the sorter is introduced into one of the coin storage grooves in the storage device, and transferred toward the downstream in conjunction with a circulating movement of the carrier belt disposed along the base of the coin storage groove. Under the condition that the ejector is set at the non-operation position, when the first coin is transferred to the ejector, a leading coin is moved to a stackable position. Then, a subsequent coin is guided in such a manner as to get on the upper surface of the leading coin kept in the stackable position, and stacked thereon in a vertical posture. This stacking operation is repeated in succeeding coins, so that these coins are sequentially stacked on each other approximately in a vertical posture within the coin storage groove.

When it is necessary to eject one or more coins stored in the vertical posture within the coin storage groove, the ejector is moved to a coin-passing enabling position. Thus, the coins are ejected outside through the ejector set at the coin-passing enabling position.

As above, the ejector disposed at the downstream end of each of the coin storage grooves can be set at the stack position of allowing the coins to be stacked on each other in a vertical posture so as to eliminate the need for placing the coin storage grooves in a vertical posture. The coin storage grooves capable of being placed in a horizontal posture make it possible to reduce the vertical length of the coin change dispenser, and contributes to downsizing of the coin change dispenser.

In the coin change dispenser of the present invention, the carrier belt may be preferably disposed along one side of the base of each of the coin storage grooves.

In this case, when a coin is moved ahead in conjunction with the movement of the carrier belt disposed along one side of the base of one of the coin storage groove, a turning force is given to the coin because one of the edges of the coin on the side of the carrier belt is moved ahead and simultaneously the other or opposite edge is in contact with the base of the coin storage groove. Thus, the coin will be moved ahead while being rotated. This allows adjacent coins having peripheral edges in contact with one another to have a repulsive interaction therebetween, so that the coins are smoothly transferred all the time without the occurrence of problems, such as coin jam in the passage.

Further, in the coin change dispenser of the present invention, the ejector may preferably include an ejection belt having a carrying surface inclined upward toward downstream, and a lower end facing the base of each of the coin storage grooves, and an ejection control member having a stopper adapted to be moved to get close to and away from the carrying surface of the carrier belt.

In this case, when the stopper of the ejection control member is in contact with the top surface of the circulatingly moving ejection belt, a leading coin transferred toward downstream within one of the coin storage grooves in conjunction with the circulation of the carrier belt is guided and pulled up by the ejection belt, and then butted against and stopped by the stopper to restrict any further movement thereof. Thus, the leading edge of a subsequently transferred coin is moved to get on the top surface of the leading coin, and the subsequent coin is stacked approximately on the leading coin by a frontward force given by the circulating movement of the carrier belt. This operation will be repeated between a succeeding coin and a preceding coin to sequentially stack coins transferred within the coin storage grooves.

Then, when it is necessary to eject one or more coins stored within the coin storage groove in the stacked state, the stopper of the ejection control member is moved to get away from the surface of the ejection belt. Thus, the restriction imposed by the stopper on the movement of the coins is released, and thereby the coins are transferred in conjunction with the circulating movement of the ejection belt, and finally ejected outside.

The ejection control member including the stopper adjacent to the ejection belt makes it possible to control the coin-storing operation and the stored-coin ejecting operation only by varying the distance between the stopper and the ejection belt under the condition that both the carrier belt and the ejection belt are continuously driven. Thus, the structure for controlling the coin storage and ejection can be simplified.

BEST MODE FOR CARRYING OUT THE INVENTION

Figure 1:
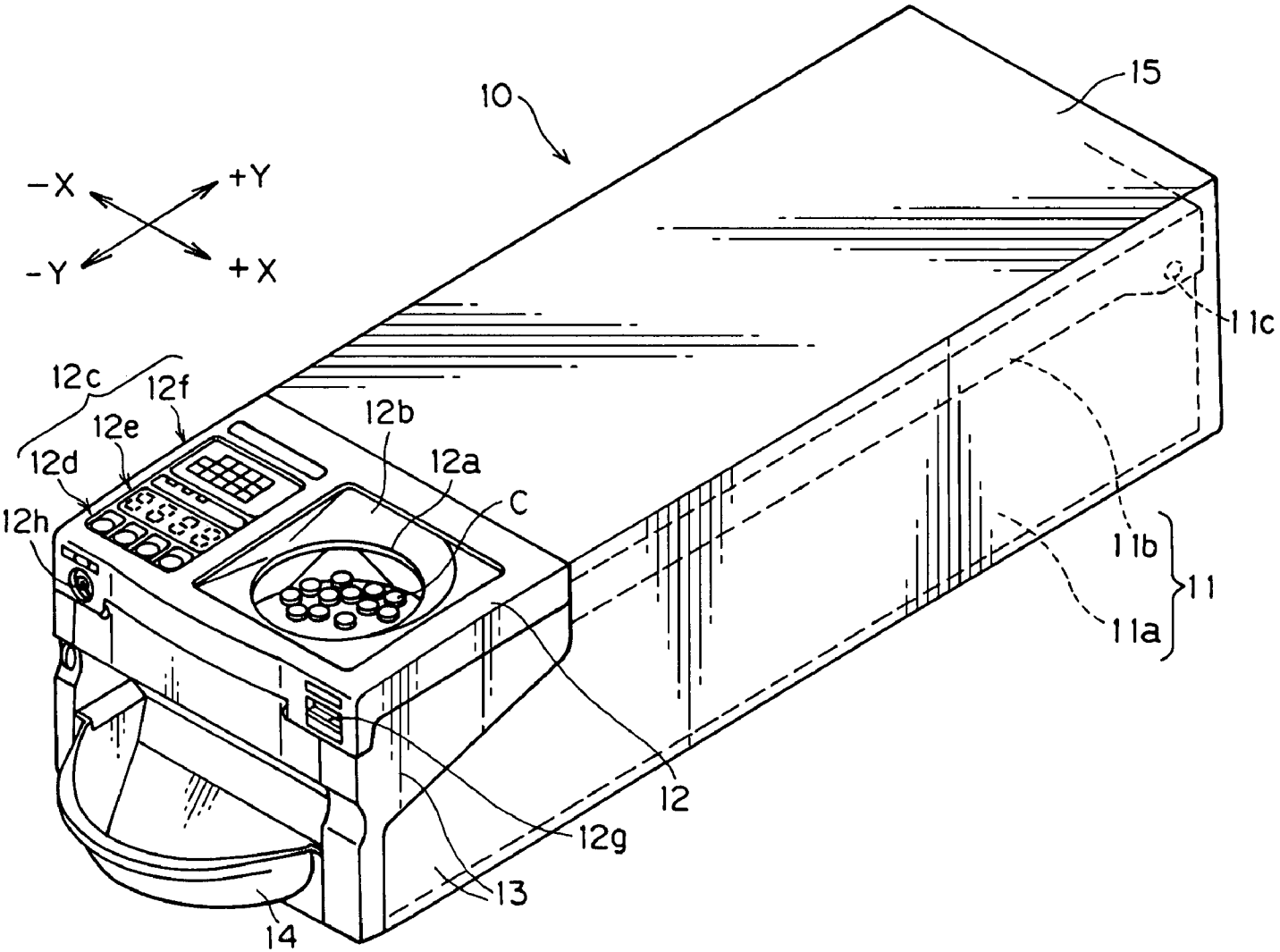
FIG. 1 is an external perspective view showing a coin change dispenser according to one embodiment of the present invention.

FIG. 1 is an external perspective view showing a coin change dispenser according to one embodiment of the present invention. The X-X direction and Y-Y direction in FIG. 1 are hereinafter referred to as "width direction" and "longitudinal direction", respectively. In particular, the −X direction, +X direction, −Y direction and +Y direction are hereinafter referred to as "leftward", rightward", "frontward" and "rearward", respectively.

As shown in this figure, the coin change dispenser 10 is designed to have a rectangular parallelepiped-shaped external appearance with a long length, and formed by mounting various devices in a frame 11 having a box or pit shape in top plan view. The frame 11 comprises a basic frame 11*a* serving as a structural base of the coin change dispenser 10, and an openable frame 11*b* superimposed on an upper portion of the basic frame 11*a*, and adapted to be swingable around a connecting shaft 11*c* provided at the rear end of the basic frame 11*a* to extend in the width direction, in such a manner as to be variably moved between an open position and a closed position.

The coin change dispenser 10 includes a frontward upper decorative member 12 detachably attached to a frontward upper portion of the basic frame 11*a*, a pair of frontward side decorative members 13 disposed on opposite sides in the width direction and fixed to respective frontward side portions of the basic frame 11*a*, a coin tray 14 disposed at a frontward lower portion of the basic frame 11*a* and sandwiched between the pair of frontward side decorative members 13, and a cover member 15 detachably attached to the basic frame 11*a* at a rearward position relative to the frontward upper decorative member 12. The exterior shape of the coin change dispenser 10 is defined by these components.

The top surface of the frontward upper decorative member 12 has a rightward region provided with a funnel portion 12*b* having a circular hole 12*a* for allowing a coin to be put in the coin change dispenser 10, and a leftward region provided with a manipulation portion 12*c*. The operation portion 12*c* is provided as a means to manually enter various inputs into the coin change dispenser 10 and to display an output about the operational state of the coin change dispenser 10 according to need. The operation portion 12*c* has a plurality of manual operation buttons 12*d* and ten-key keypads 12*f*, as an input device, and a 4-digit, 7-segment LED (Light-Emitting Diode) 12*e*, as an output device.

Further, the front surface of the frontward upper decorative member 12 has a rightward region provided with a power switch 12*g*, and a leftward region provided with a key hole 12*h*. The key hole 12*h* is provided as a means to release a lock for fixing the frontward upper decorative member 12 to the frame 11. Specifically, a key (not shown) can be inserted into the key hole 12*h* to perform a lock-releasing operation, whereby the frame 11 can be pulled out relative to the cover member 15.

The coin change dispenser 10 is designed such that, when a given one of the manual operation buttons 12*d* is pushed plural times, respective remaining amounts of different types of coins stored in the coin change dispenser 10 can be displayed on the 4-digit, 7-segment LED 12*e* in turn in response to each of the push operations.

The coin change dispenser 10 is also designed such that when a plurality of coins C consisting of a mixture of various types of coins are put in the funnel portion 12*b*, these coins C are subjected to a given treatment in the coin change dispenser 10, and stored in a given storage zone (aftermentioned coin storage grooves 63) on a coin type by type basis. Further, the coin change dispenser 10 is designed such that, when a given one of the manual operation buttons 12*d* in the operation portion 12*c* is operated, or a control signal from a cash registration device (not shown) is input thereinto, a change prepared by selecting each of the types of coins C to be a given amount of money is ejected to the coin tray 14.

Figure 2:
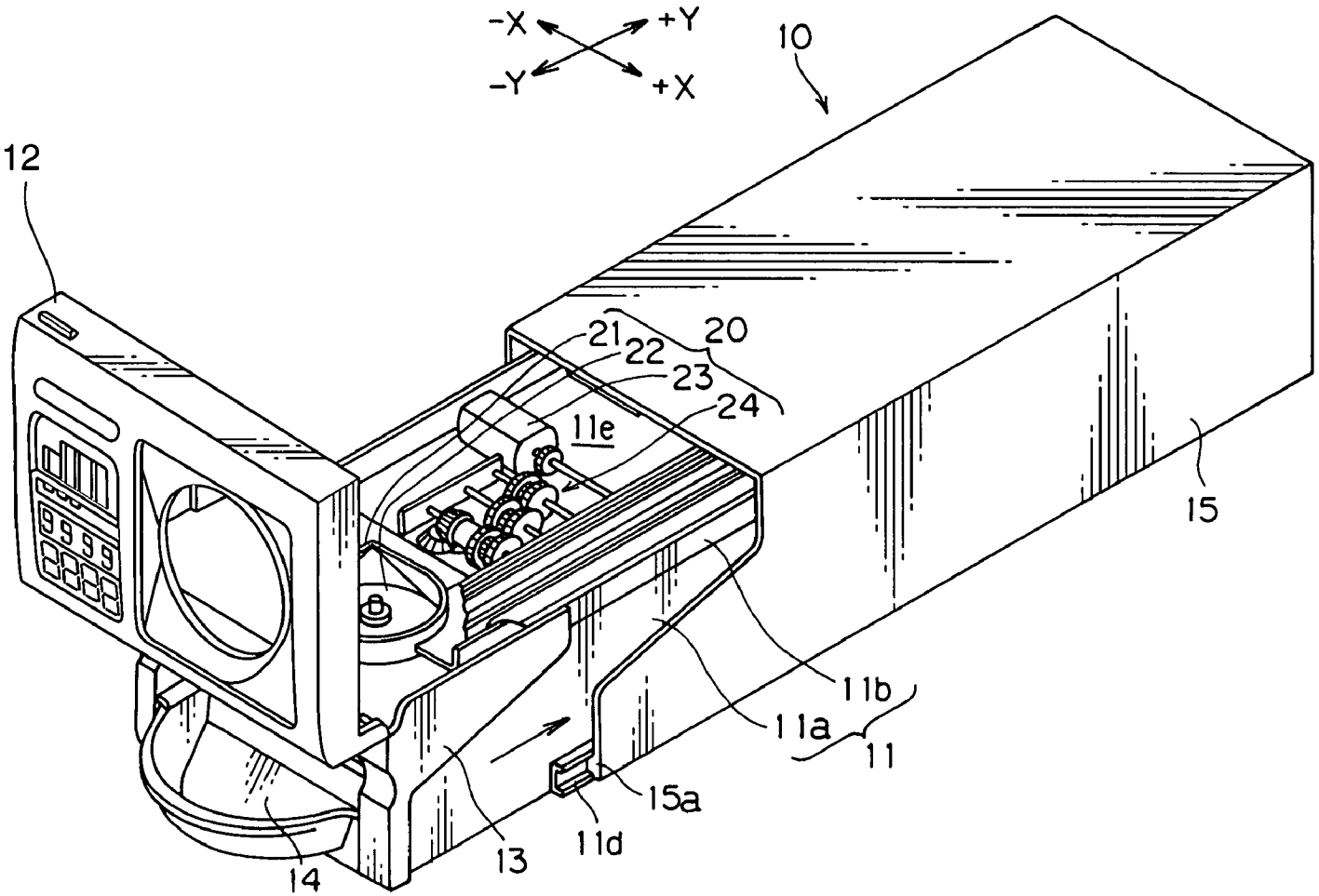
FIG. 2 shows one state of the coin change dispenser illustrated in FIG. 1, wherein a frontward upper decorative member is opened, and a cover member is being detached.
Figure 3:
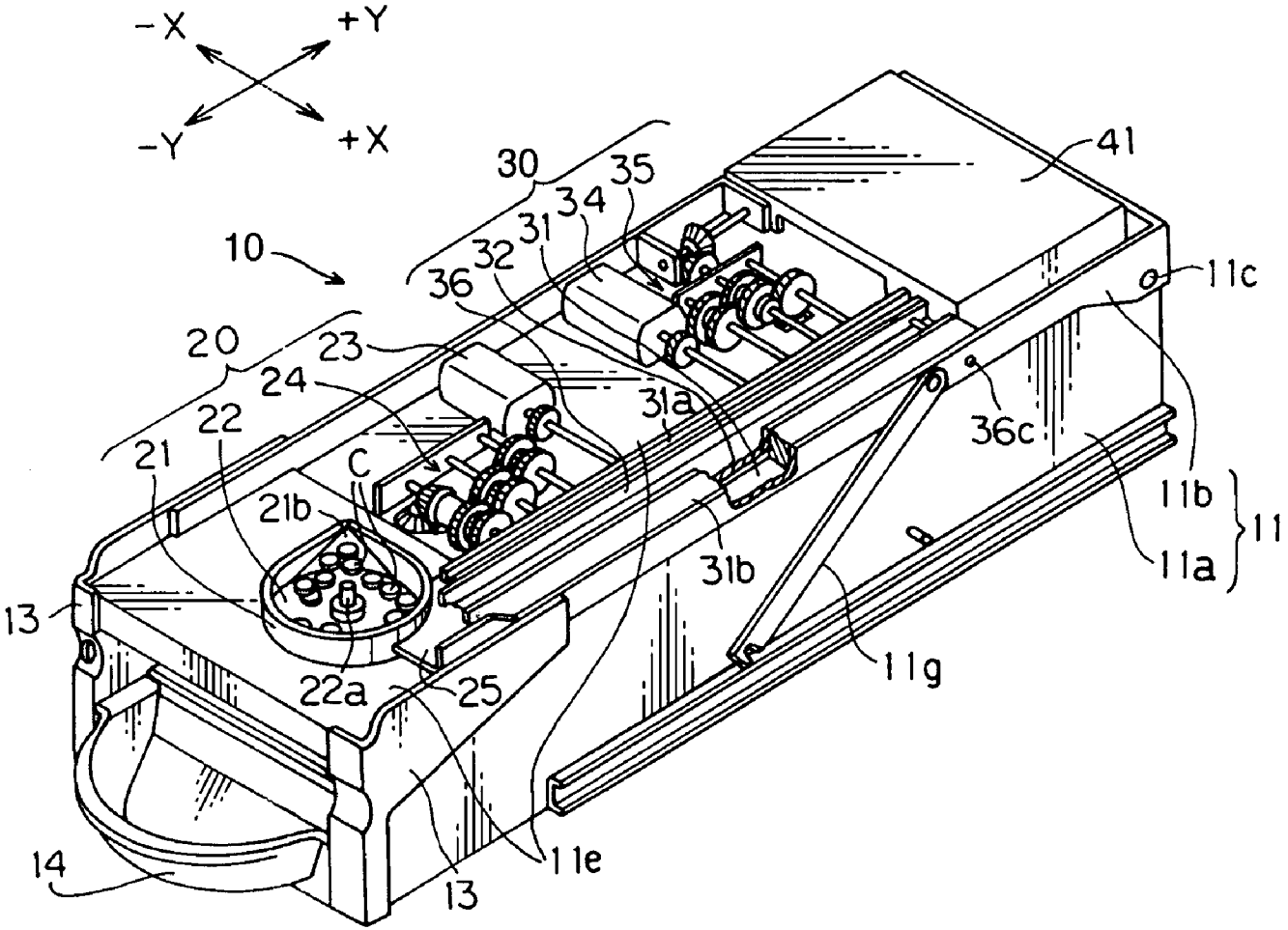
FIG. 3 is a perspective view showing another state of the coin change dispenser illustrated in FIG. 1, wherein the frontward upper decorative member and the cover member are detached.
Figure 4:
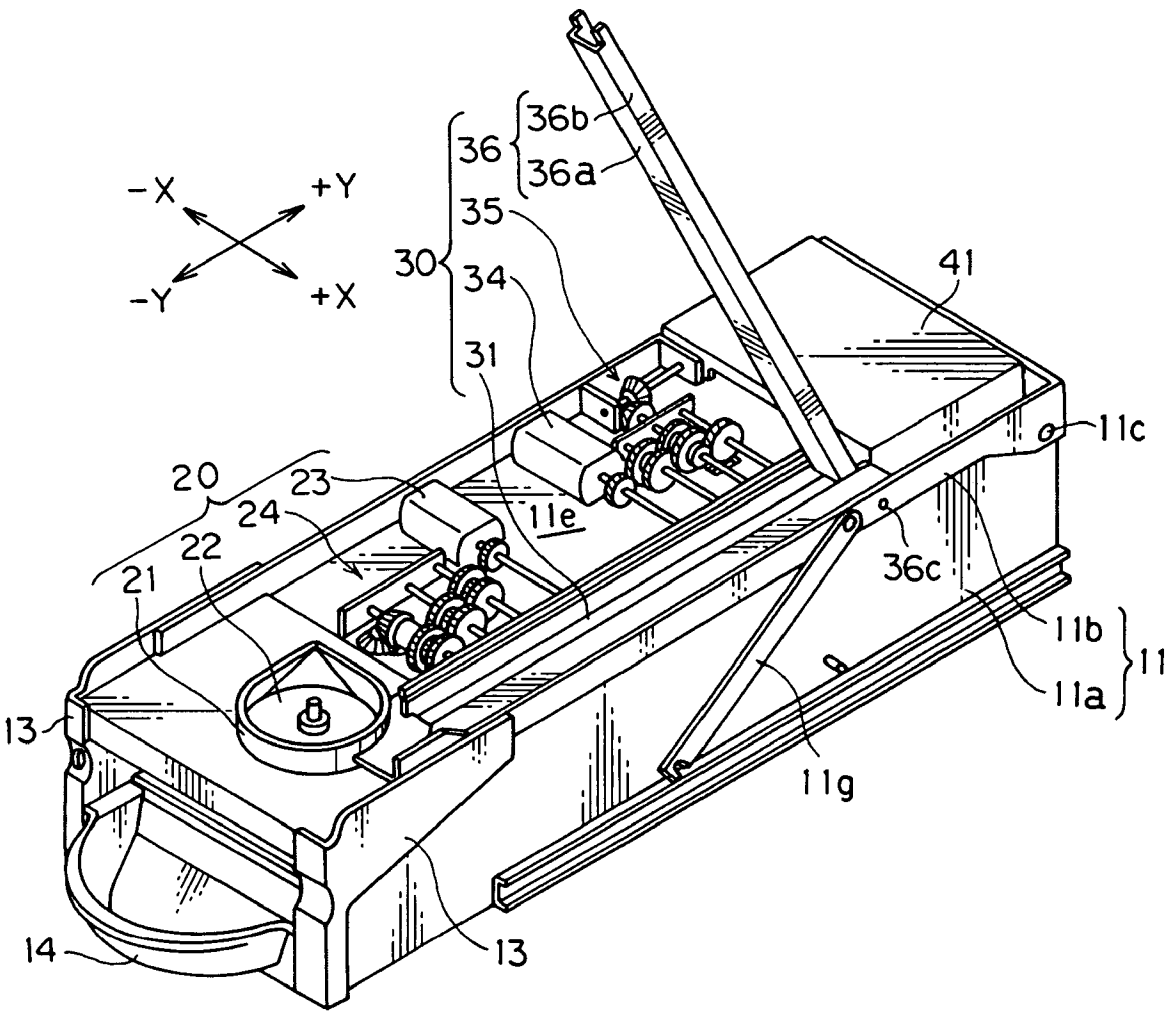
FIG. 4 shows another state of the coin change dispenser illustrated in FIG. 1, wherein a passage lid member is opened.
Figure 5:
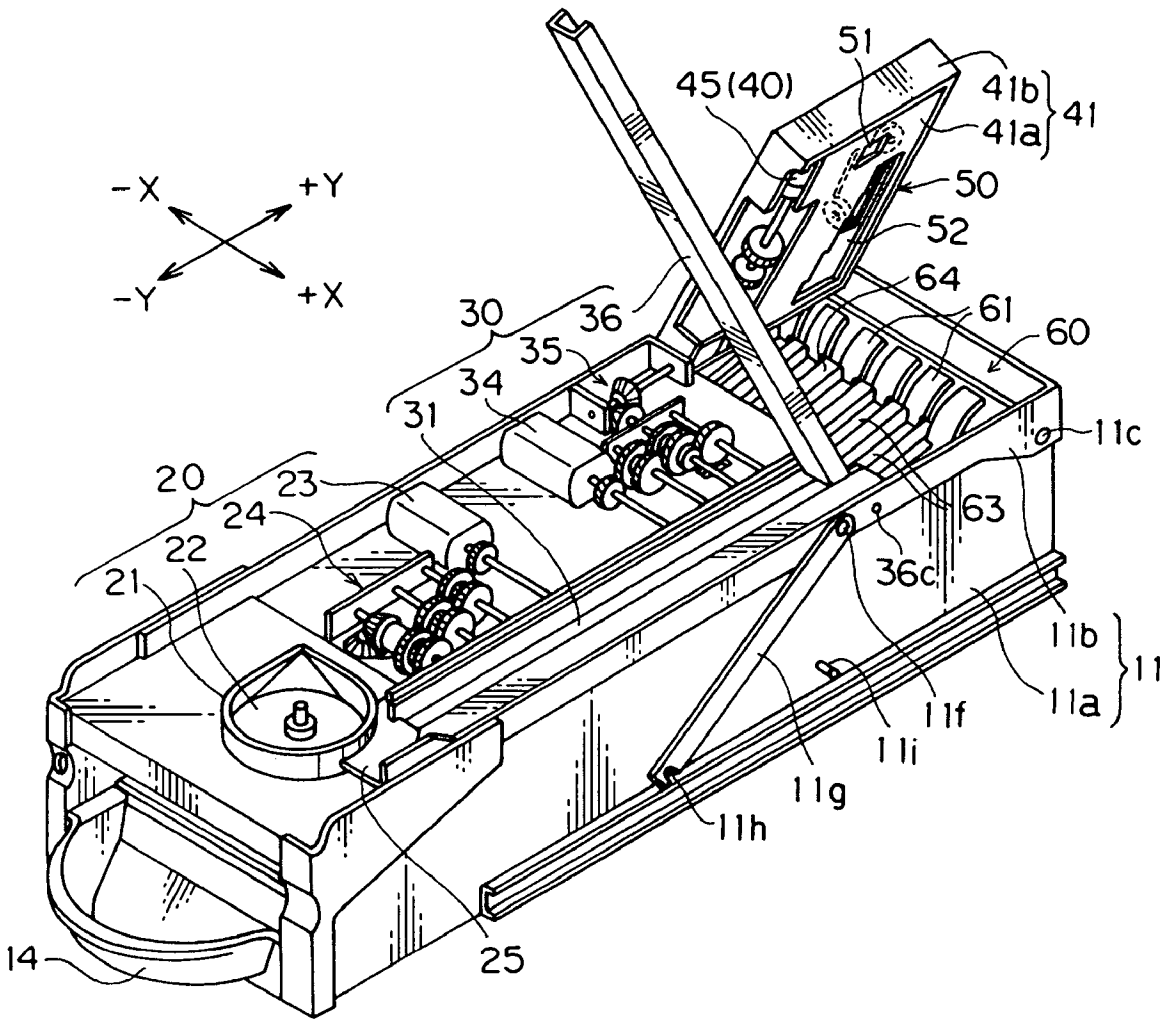
FIG. 5 shows another state of the coin change dispenser illustrated in FIG. 1, wherein a sort section frame is opened.
Figure 6:
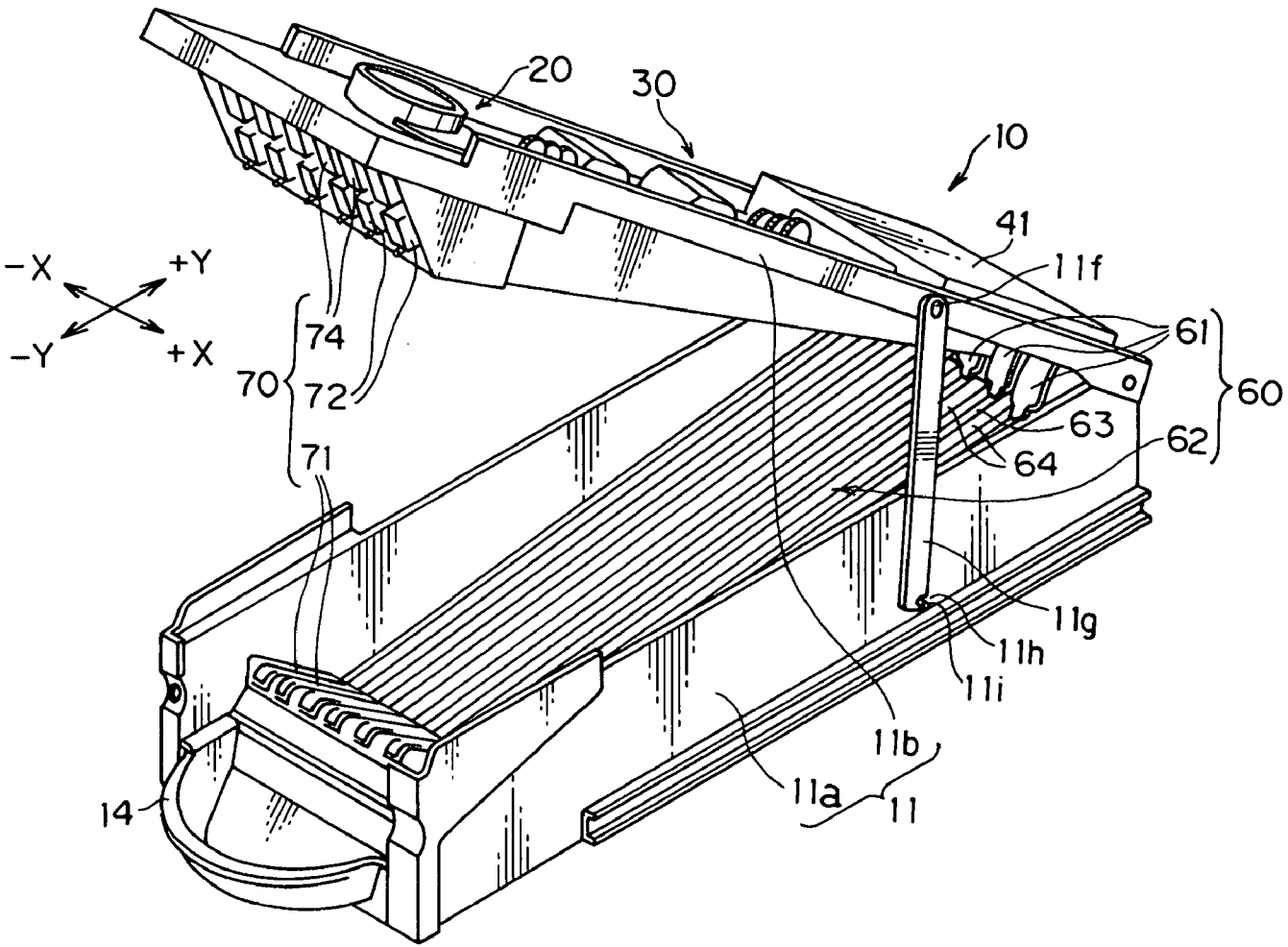
FIG. 6 shows another state of the coin change dispenser illustrated in FIG. 1, wherein an openable frame is opened.

FIGS. 2 to 6 are perspective views showing each state of the coin change dispenser 10 during a disassembly thereof. FIG. 2 shows one state wherein the frontward upper decorative member 12 is opened, and the cover member 5 is being detached. FIG. 3 is a perspective view showing another state wherein the frontward upper decorative member 12 and the cover member 15 are detached. FIG. 4 shows another state wherein a passage lid member in FIG. 3 is opened. FIG. 5 shows another state wherein a sort section frame in FIG. 4 is opened. FIG. 6 shows another state wherein the openable frame 11*b* is opened. The X-X direction and Y-Y direction in these figures are hereinafter referred to as "width direction" and "longitudinal direction", respectively. In particular, the −X direction, +X direction, −Y direction and +Y direction are hereinafter referred to as "leftward", rightward", "frontward" and "rearward", respectively.

Firstly, when a given key is inserted into the key hole 12*h* to perform a lock-releasing operation, in the state illustrated in FIG. 1, and then the cover member 15 is pulled rearward as shown in FIG. 2, the engagement of the frontward upper decorative member 12 with the cover member 15 is released. Then, when the frontward upper decorative member 12 is swung counterclockwise around a horizontal shaft (not shown) provided in the frontward side decorative members 13, the frontward upper decorative member 12 stands on the top edges of the frontward side decorative members 13 as shown in FIG. 2.

Subsequently, when the cover member 15 is fully pulled out of the basic frame 11*a*, various mechanisms provided on the top surface of the openable frame 11*b* is exposed outside. FIGS. 3 to 6 show the state after the frontward upper decorative member 12 in the standing state illustrated in FIG. 2 is detached from the frame 11.

Just for reference, a C-shaped frame 11*d* is disposed in a lower portion of each outward side surface of the basic frame 11*a* to extend in the longitudinal direction, and a guided convex strip 15*a* corresponding to the C-shaped frame 11*d* is formed in a lower portion of each inner side surface of the cover member 15. This guided convex strip 15*a* can be fitted in the groove of the C-shaped frame 11*d* in a slidable manner to allow the cover member 15 to be positioned relative to the basic frame 11*a*, and facilitate an attaching/detaching operation of the cover member 15.

As shown in FIG. 3, in the state after the frontward upper decorative member 12 and the cover member 15 are detached, the various devices (associated with an after-mentioned coin input section 20, an after-mentioned first transfer section 30, etc.) disposed on a top panel 11*e* of the openable frame 11*b* are exposed.

The top panel 11*e* has a right region pivotally supporting an after-mentioned passage lid member 36 in a swingable manner around a support shaft 36*c* of the openable frame 11*b*. Through an opening/closing operation of this passage lid member 36, an after-mentioned first coin passage 31 can be closed (FIG. 3), or opened (FIG. 4). The passage lid member 36 is provided as a means to prevent the coins C from jumping up and down during transfer, and may be opened in the event of the occurrence of coin jam or for a maintenance work.

Further, a second-transfer-section frame 41 for internally mounting various devices of an after-mentioned second transfer section 40 is provided on the rearward side of the top panel 11*e*. This second-transfer-section frame 41 is pivotally supported by a given shaft provided in the left side portion of the openable frame 11*b* in a swingable manner around the shaft. Through an operation for the swing movement around this shaft, the second-transfer-section frame 41 can be moved between a closed position as shown in FIG. 4 and an open position as shown in FIG. 5.

Furthermore, a protrusion-supported rod 11*g* is pivotally supported by a short shaft 11*f* in a swingable manner around the short shaft 11*f* at a position located slightly rearward from the longitudinal center of the right side portion of the openable frame 11*b*. This protrusion-supported rod 11*g* has a lower end formed with a concave engagement groove 11*h* having a rearward-facing opening, and an engagement protrusion 11*i* corresponding to the engagement groove 11*h* is standingly provided in the lower region of the right side portion of the basic frame 11*a* and right under the short shaft 11*f*.

After the openable frame 11*b* is swung clockwise around the connection shaft 11*c*, the engagement groove 11*h* can be fit in the engagement protrusion 11*i* to maintain the state in which the openable frame 11*b* mounting the coin input section 20, the first transfer section 30, the second transfer section 40 and the coin sort section 50 is opened relative to the basic frame 11*a*.

With reference to FIGS. 7 to 14, and, if needed, additionally FIGS. 1 to 6, the coin change dispenser 10 will be described in detail below.

Figure 7:
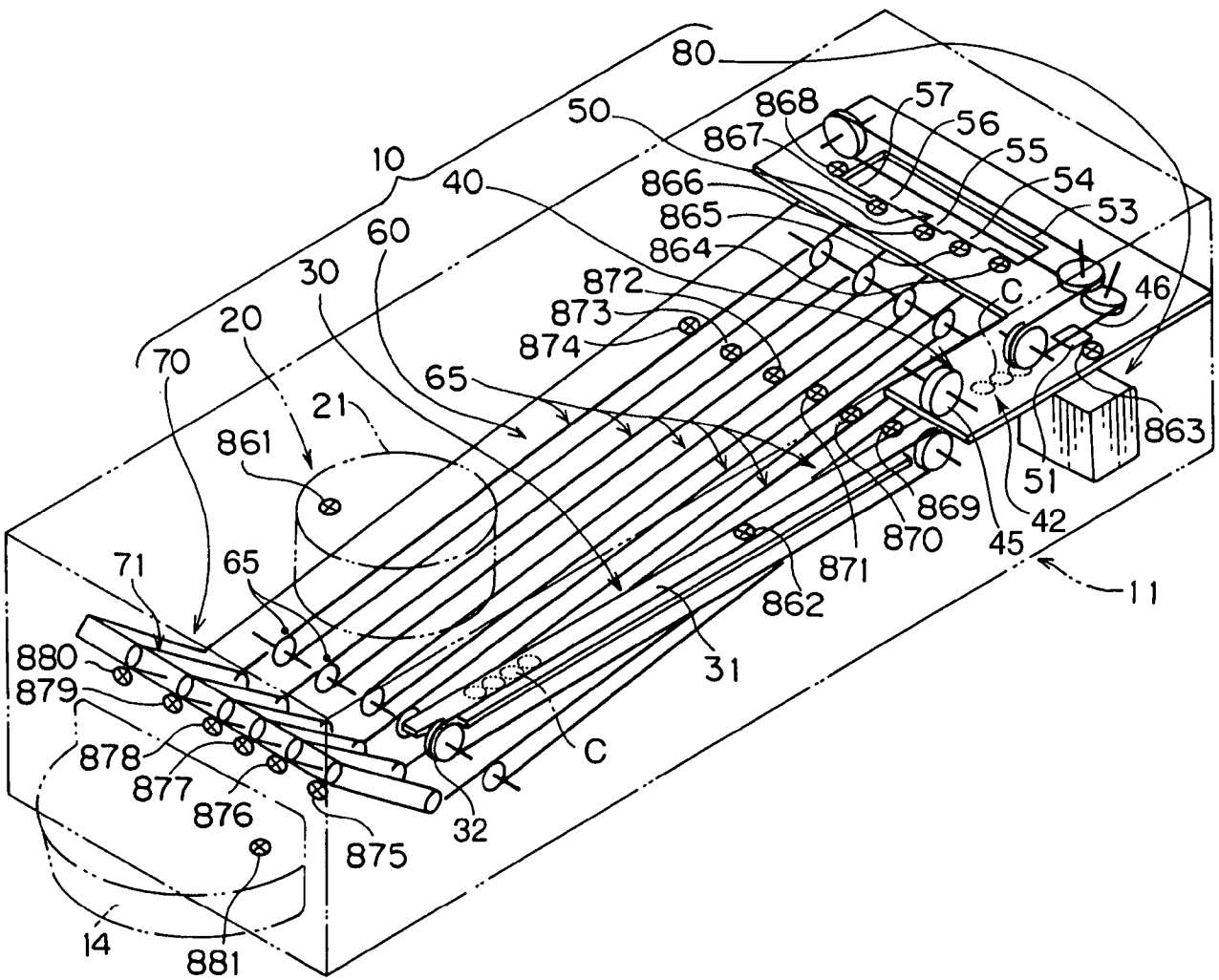
FIG. 7 is an explanatory schematic perspective view of the structure of the coin change dispenser.

FIG. 7 is an explanatory schematic perspective view of the structure of the coin change dispenser 10. As shown in FIG. 7, the coin change dispenser 10 comprises a coin input section 20 for introducing various types of coins C thereinto, a first transfer section 30 for transferring the coins C fed from the coin input section 20, toward the rearward region of the openable frame 11*b*, a second transfer section 40 for transferring the coins C fed from the first transfer section 30 further rearward, and then transferring the coins C after turning the coins C perpendicularly and leftward (in a direction from the top surface to the back surface of the drawing sheet of FIG. 7), a coin sort section 50 for sorting the coins C perpendicularly turned by the second transfer section 40, into their coin types, a coin storage section 60 for storing the coins sorted by the coin sort section 50 on a coin type by type basis, a coin ejection section 70 for ejecting the coins C stored in the coin storage section 60 to the coin tray 14, and a control section 80 for controlling the drive of the coin change dispenser 10.

As shown in FIGS. 7 and 3, the coin input section 20 includes an input hopper 21 formed in an annular shape in top plan view in such a manner as to allow various types of coins to be put therein, and provided in a frontward region of the top surface of the top panel 11*e* of the openable frame 11*b*, a rotary tray 22 disposed at the bottom of the input hopper 21, a first motor 23 for rotatively driving the rotary tray 22, and a first reduction gear train 24 interposed between the first motor 23 and the rotary tray 22.

The input hopper 21 has a circumferentially elongated feed hole 21*a* (see FIG. 8) formed in a rightward/obliquely rearward region of the peripheral wall thereof to feed the coins C therein outside, and a horn-shaped expanded portion 21*b* (see FIG. 3) formed in a region of the peripheral wall on the leftward side elative to the feed hole 21*a* by radially expanding a part of a circular shape in top plan view. The expanded portion 21*b* has a bottom surface inclined downward toward the center of the input hopper 21.

The rotary tray 22 is integrally formed with a center shaft 22*a* vertically penetrating therethrough at the center thereof. The center shaft 22*a* is designed such that a driving torque of the first motor 23 is transmitted thereto through the first reduction gear train 24. In this embodiment, the rotational direction of the center shaft 22*a* is set such that the rotary tray 22 is rotated clockwise around the axis thereof.

According to the above structure of the coin input section 20, when a plurality of coins C are put in the input hopper 21 under the condition that a driving force of the first motor 23 is transmitted to the rotary tray 22 through the first reduction gear train 24 and the center shaft 22, and the rotary tray 22 is rotated clockwise together with the center shaft 22*a*, the coins C on the rotary tray 22 are moved in synchronous with the rotation of the rotary tray 22. Each of the coins C is circulatingly moved while being brought into contact with the inner peripheral surface of the annular wall of the input hopper 21 due to a resulting centrifugal force, and discharged from the feed hole 21*a* toward the first transfer section 30.

Figure 8:
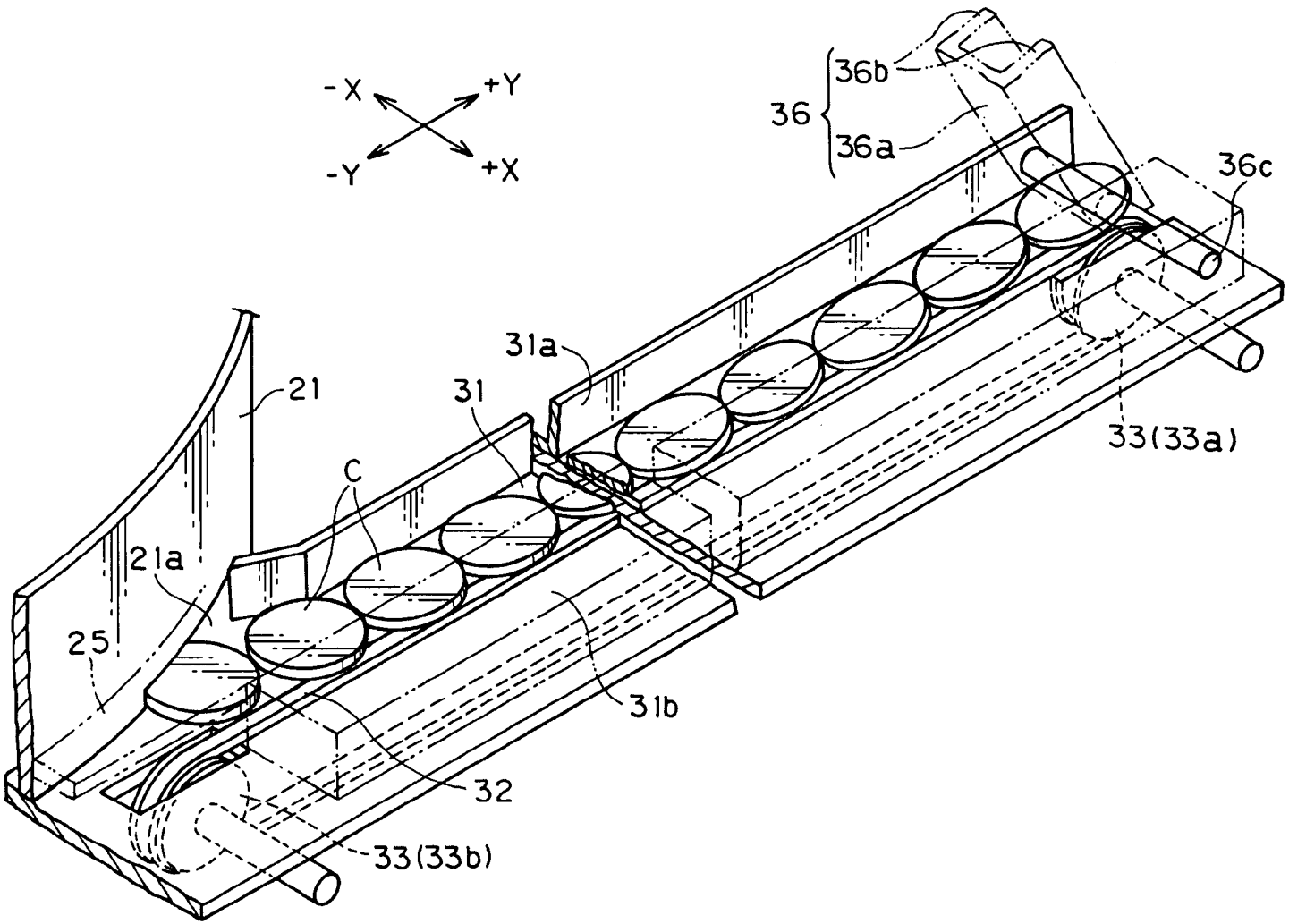
FIG. 8 is a partly broken perspective view showing one example of a first transfer section.

FIG. 8 is a partly broken perspective view showing one example of the first transfer section 30. As shown in FIG. 8 and the foregoing FIG. 7, the first transfer section 30 includes a first coin passage 31 arranged to extend in the longitudinal direction along the right region of the top panel 11*e* of the openable frame 11*b*, a first carrier belt 32 tensionally wound around between pulleys 33 to extend in the longitudinal direction along a right side zone within the first coin passage 31, a second motor 34 (see FIG. 3) for circulatingly driving the first carrier belt 32 through one of the pulleys 33, a second reduction gear train 35 (see FIG. 3) interposed between the second motor 34 and the above pulley 33, and a passage lid member 36 for covering over the first coin passage 31 in an openable and closable manner. The pulleys 33 are comprised of a driving pulley 33*a* disposed under and at the downstream end of the first coin passage 31 and adapted to receive a driving force of the second motor 34 through the second reduction gear train 35, and a driven pulley 33*b* disposed at the upstream end of the first coin passage 31 and adapted to receive a rotational force of the driving pulley 33*a* through the first carrier belt 32.

The first coin passage 31 is set to have a passage width slightly greater than the diameter of one type of coin C having a largest diametral dimension, so as to allow the entire types of coins C to be transferred therethrough. The first coin passage 31 has a leftward edge provided with a left sheathing portion 31*a* extending in the longitudinal direction, and a rightward edge provided with a right sheathing portion 31*b* extending in the longitudinal direction. These sheathing portions 31*a*, 31*b* prevent a coin C from deviating in the width direction.

Further, a protective plate 25 is disposed outside the input hopper 21 and adjacent to the feed hole 21*a* to prevent a coin C discharged from the feed hole 21*a* from jumping up and down. The presence of the protective plate 25 allows a coin C fed from the feed hole 21*a* to be smoothly received in the first coin passage 31.

The first carrier belt 32 is set to have a belt width less than the radius of one type of coin having a smallest dimension. The first carrier belt 32 is tensionally wounded around between the driving pulley 33*a* and the driven pulley 33*b* in such a manner as to allow the forwarding or upper portion of the carrier belt to be in sliding contact with the top surface of the first coin passage 31 and the right sheathing portion 31*b*, so that a returning or lower portion of the carrier belt is moved under the bottom surface of the first coin passage 31. Thus, one of the opposite edges of a coin C discharged from the feed hole 21*a* of the input hopper 21 is moved to get on the first carrier belt 32 in the first coin passage 31 to have an inclined posture, and moved ahead along the first coin passage 31 while being rotated counterclockwise in top plan view by the circulating movement of the first carrier belt 32. This rotation makes it possible to smoothly move coins C ahead without coin jam.

The passage lid member 36 is provided as a means to prevent coins C being transferred on the first coin passage 31 from jumping up and down. For this purpose, the passage lid member 36 comprises a bottom or base plate 36*a* (see FIG. 4) having a length dimension approximately equal to that of the first coin passage 31, and a pair of side walls 36*b* extending upward from respective width-directional side edges of the base plate 36*a*.

The support shaft 36*c* installed between the sheathing portions 31*a*, 31*b* is penetratingly inserted into respective downstream portions of the side walls 36*b*, so that the passage lid member 36*b* is pivotally supported by the support shaft 36*c* in a swingable manner around the support shaft 36*c*. Through an operation for the swing movement around this support shaft 36*c*, the passage lid member 36*b* can be moved between a closed position (see FIG. 3) where the first coin passage 31 is closed, and an open position where the first coin passage 31 is opened. Further, the passage lid member 36 is positioned such that, when the passage lid member 36 is set at the closed position, a gap for allowing a coin C to pass therethrough is defined between the bottom surface of the base plate 36*a* and the top surface of the first coin passage 31.

According to the above structure of the first transfer section 30, under the condition that the passage lid member 36 is set at the closed position as shown in FIG. 3, a coin C fed from the feed hole 21*a* in conjunction with the rotary tray of the input hopper 21 rotated by the driving force of the first motor 23 is moved advance while being rotated due to the right edge of the coin C placed on the first carrier belt 32 circulated between the pulleys 33*a*, 33*b* by the driving force of the second motor 34, and transferred toward the second transfer section 40.

Figure 9:
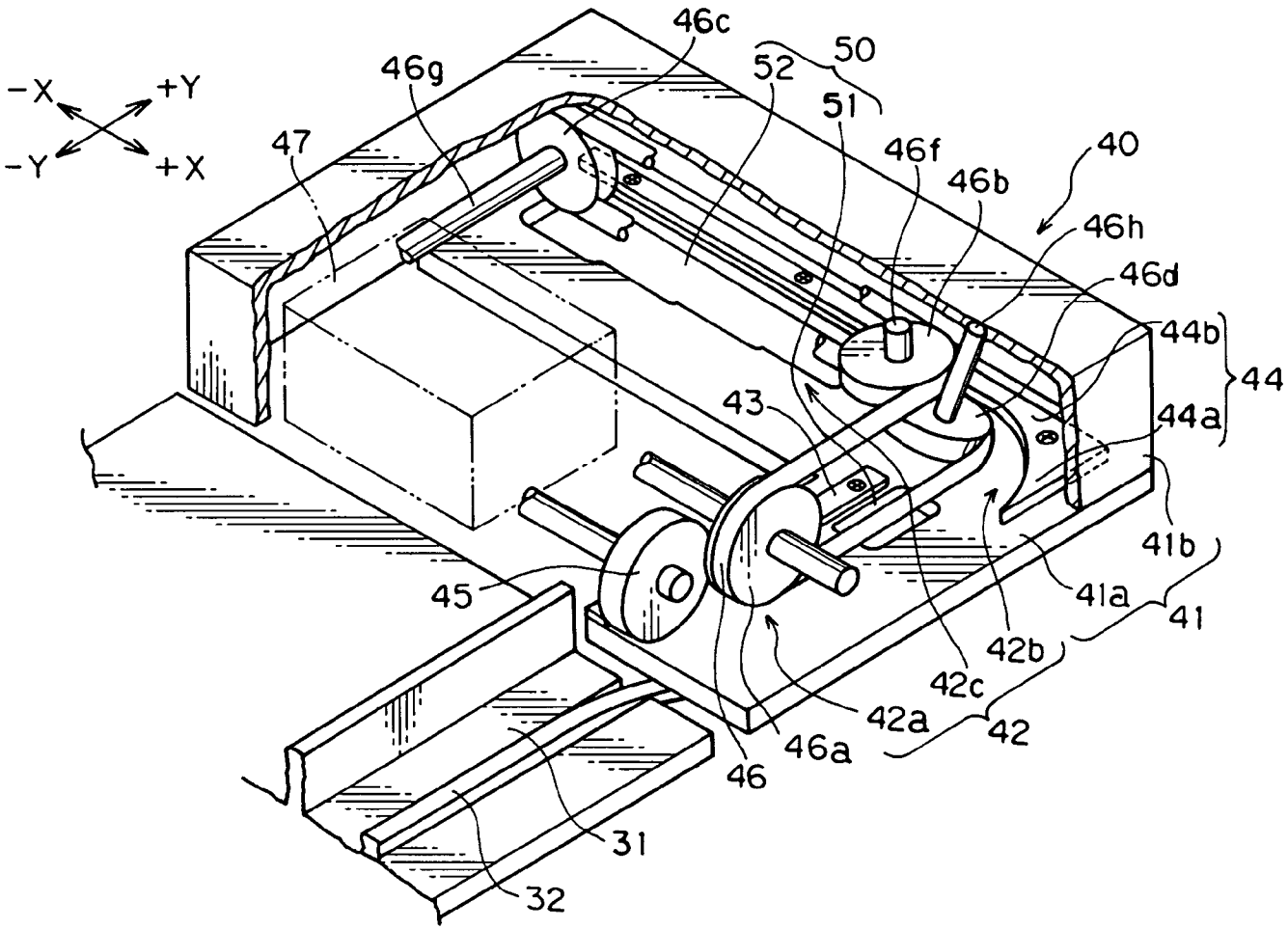
FIG. 9 is a partly broken perspective view showing one example of a second transfer section.
Figure 10:
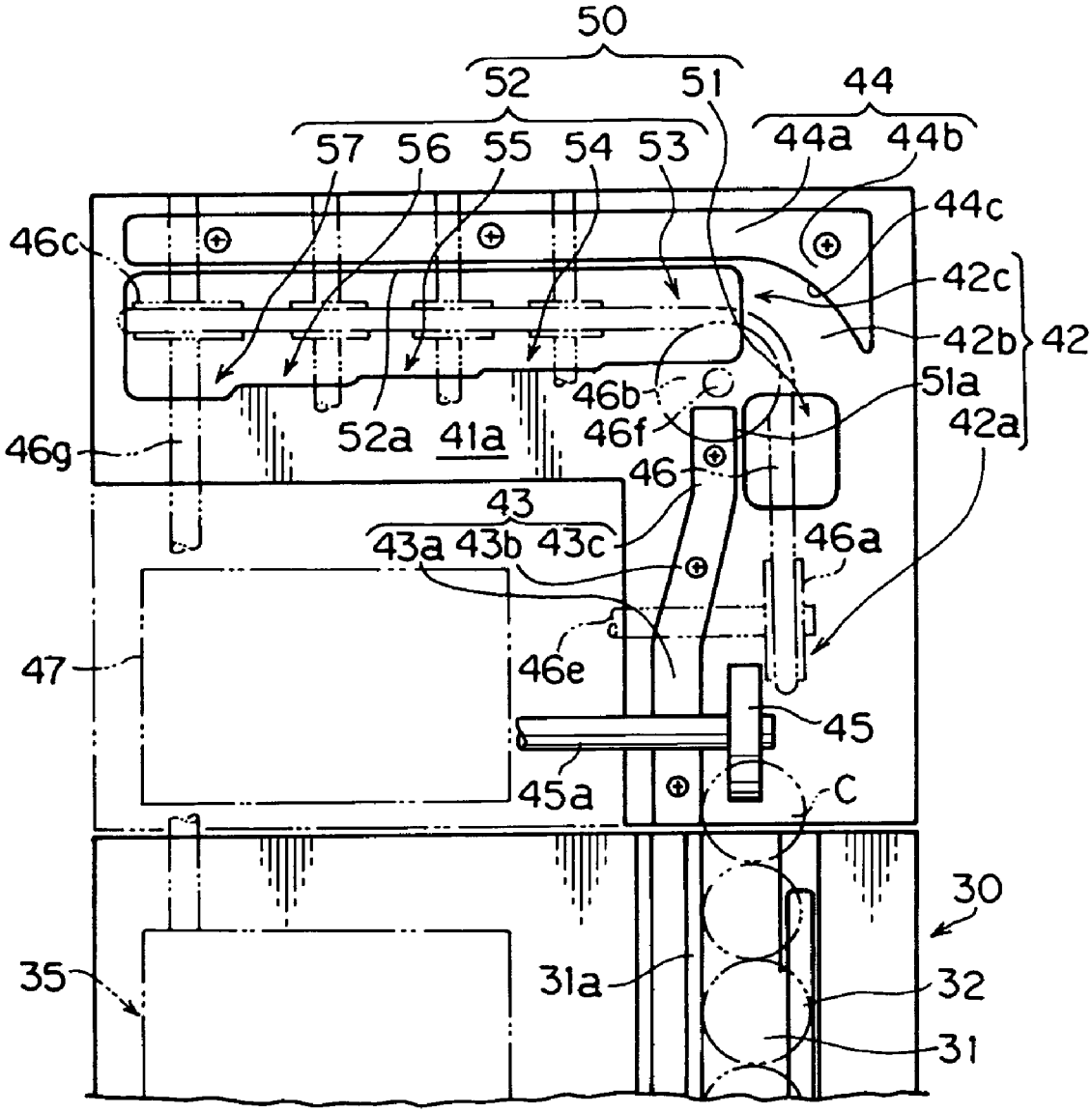
FIG. 10 is a top plan view showing one example of a second-transfer-section frame internally mounting the second transfer section and a coin sort section in FIG. 9.

FIG. 9 is a partly broken perspective view showing each example of the second transfer section 40 and the coin sort section 50. FIG. 10 is a top plan view showing one example of a base plate 41*a* of the second-transfer-section frame 41 internally mounting the second transfer section 40 and the coin sort section 50 in FIG. 9. As shown in FIG. 9, the second transfer section 40 comprises the bottom or base plate 41*a* having a rectangular shape in top plan view, and a box-shaped cover member 41*b* covering over the top surface of the base plate 41*a*.

A second coin passage 42 is defined on the base plate 41*a*. This second coin passage 42 includes an upstream straight passage 42*a* linearly connected with the first coin passage 31, a curved passage 42*b* curving leftward from the downstream end of the upstream straight passage 42*a*, and a coin sort passage 42*c* extending leftward from the downstream end of the curved passage 42*b*.

The top surface of the base plate 41*a* is provided with a first positioning convex strip 43 mounted on a leftward region of the upstream straight passage 42*a*, and a second positioning convex strip 44 mounted on a rear end region of the base plate 41*a* to extend from the outer edge of the curved passage 42*b* to the coin sort passage 42*c*.

As shown in FIG. 10, the first positioning convex strip 43 has a first linear portion 43*a* in which its right edge located on the upstream side relative to the longitudinal center of the first positioning member 43 is flush with the right surface of the left sheathing portion 31*a* in the first transfer section, an oblique portion 43*b* extending from the downstream end of the first linear portion 43*a* to have a right edge slightly oblique rightward, and a second linear portion 43*c* extending from the downstream end of the oblique portion 43*b* in parallel with the first linear portion 43*a*. Thus, a coin C introduced into the upstream straight passage 42*a* is firstly moved ahead while being brought into contact with the first linear portion 43*a*, and then brought into contact with and guided by the right edge of the oblique portion 43*b* serving as a reference position for determining a coin position, and thereby moved to the relatively leftward side of the upstream straight passage 42*a*. Finally, the coin C is brought into contact with the second linear portion 43*c*, and moved ahead along a reference course in the positioned state.

The second positioning convex strip 44 is disposed spaced apart from the downstream end of the first positioning protrusion 43 by a distance equivalent to the total diameter of about one and a half to two coins C, and extends in the width direction within the rear end region of the base plate 41*a*. The second positioning convex strip 44 is comprises of a linear convex strip body 44*a* and an arc-shaped convex strip 44*b* located at the right end of the convex strip body 44*a* and formed with an arc-shaped concave portion. The arc-shaped convex strip 44*b* has an arc-shaped edge 44*c* extending along the outside curve of the curved passage 42*b* and having a curvature radius equal to that of this outside curve. Thus, a coin C introduced into the curved passage 42*b* is guided by the arc-shaped edge 44*c* in such a manner that it is turned leftward and introduced into the coin sort passage 42*c*.

Further, a speed-reducing roller 45 is disposed on the upstream side of the upstream straight passage 42*a*, and a second carrier belt 46 is disposed on the downstream side of the upstream straight passage 42*a* and at a position corresponding to the curved passage 42*b* and the coin sort passage 42*c*.

The speed-reducing roller 45 is made of an elastic material, such as rubber or soft synthetic resin material, and attached to a roller support shaft 45*a* extending in the width direction in such a manner that it is rotated together with and around the roller support shaft 45*a*. The roller support shaft 45*a* is designed to receive a driving force of the second motor 34 through the second reduction gear train 35 and a third reduction gear train 47 to be exclusively used for the second transfer section 40 and coin sort section 50.

The speed-reducing roller 45 is disposed at a position corresponding approximately to the width-directional center of the first coin passage 31, and a gap between the peripheral surface of the speed-reducing roller 45 and the top surface of the upstream straight passage 42*a* is set at a value less than the thickness of a coin C. Thus, a coin c pushed out of the downstream end of the first coin passage 31 by the driving of the first carrier belt 32 is introduced between the peripheral surface of the speed-reducing roller 45 being rotated on the upstream end of the upstream straight passage 42*a*, and the top surface of the upstream straight passage 42*a*. Thus, the speed-reducing roller 45 having a resulting compressive elastic deformation allows the speed of the coin C to be set at a value equal to the circumferential speed thereof, and the coin C is transferred toward downstream at this speed.

In this embodiment, the circumferential speed of the speed-reducing roller 45 is set at a value less than a transfer speed of coins C in the first coin passage 31. Thus, a coin C fed out of the first coin passage 31 goes into such a situation that it is once blocked by the speed-reducing roller 45, and thereby a subsequent coin C is brought into contact with the trailing edge of the preceding coin C on the first coin passage 31 and kept slipping relative to the first carrier belt 32.

The second carrier belt 46 is made of an elastic material, such as rubber or soft synthetic resin material, and the width dimension thereof is set at a value less than the radius of a coin C (a round belt having a circular sectional shape is employed in this embodiment). This second carrier belt 46 is bent in conformity to a potion of the upstream straight passage 42*a* located on the rearward side relative to the intermediate position thereof, the curved passage 42*a* and the coin sort passage 42*c*, and disposed on the base plate 41*a* of the second-transfer-section frame 41. The second carrier belt 46 is tensionally wound around a first pulley 46*a*, a second pulley 46*b*, a third pulley 46*c* and a fourth pulley 46*d*, which are disposed on the base plate 41*a*.

The first pulley 46*a* is supported by a first shaft 46*e* parallel to the roller support shaft 45*a*, in a rotatable manner around the first shaft 46*e*, and disposed parallel to the speed-reducing roller 45 and at a position displaced slightly rightward on the downstream side of the speed-reducing roller 45. The second pulley 46*b* is arranged to allow the peripheral surface thereof to be located slightly radially outward relative to the inside curve of the curved passage 42*b*. This second pulley 46*b* is supported by a second shaft 46*f* extending downward from the top panel of the cover member 41, in a rotatable manner around the second shaft 46*f*. The third pulley 46*c* is integrated with and supported by a third shaft 46*g* disposed at the downstream end of the coin sort passage 42*c* to extend in the longitudinal direction.

The third shaft 46*g* is designed to receive a driving force of the second motor 34 through the second reduction gear train 35 and the third reduction gear train 47 and to serve as a driving shaft. When the third shaft 46*g* is driven and rotated, the second carrier belt 46 can be circulated between the first to fourth pulleys 46*a* to 46*d*.

As shown in FIG. 10, the second carrier belt 46 tensionally wound around between the first to fourth pulleys 46*a* to 46*d* has a hook-like shape to extend along the top surface of and in conformity to the shape of the second coin passage 42, and a gap between the bottom surface of the forwarding portion of the second carrier belt 46 and the top surface of the base plate 42*a* is set at a value slightly less than a thickness dimension of a coin C. Thus, the second carrier belt 46 can be designed to move its forwarding portion toward downstream, so that a coin C placed on the second coin passage 42 and pressed by the elastically deformed second carrier belt 46 is slidingly moved ahead on the second coin passage 42 by a frictional force between the coin C and the second carrier belt 46.

Figure 11A:
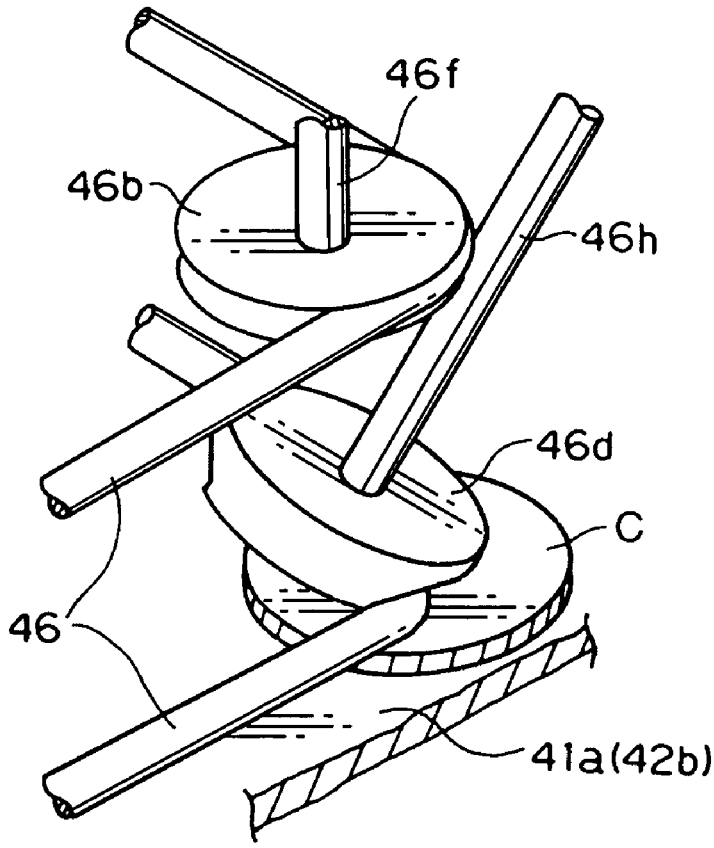
FIG. 11 shows the arrangement of a forth pulley, wherein (A) is a perspective view, and (B) is a sectional view.
Figure 11B:
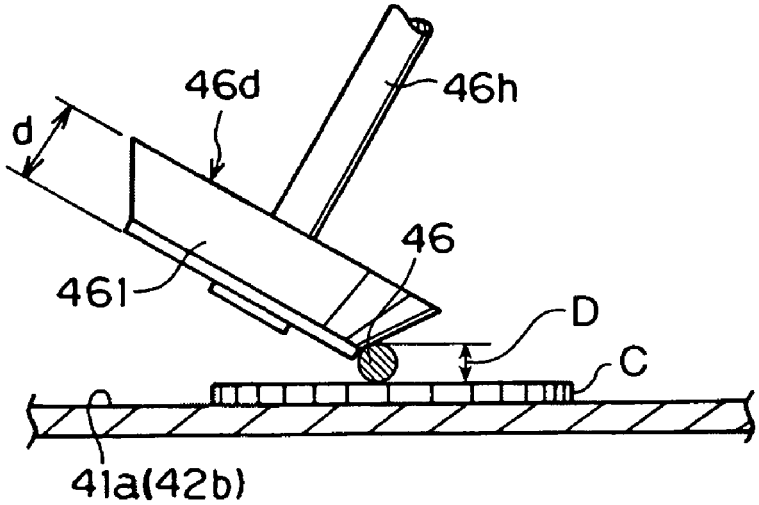

In this embodiment, the fourth pulley 46*d* is supported by a fourth shaft 46*h* (see FIG. 9) extending obliquely downward from an appropriate position of the top panel just above the second pulley 46*b*, in a rotatable manner around the fourth shaft 46*h*. FIG. 11 shows the arrangement of the forth pulley 46*d*, wherein (A) is a perspective view, and (B) is a sectional view. As shown in FIG. 11, the fourth pulley 46*d* generally has a reverse truncated-cone shape, and the thickness dimension d thereof is set at a value greater than the diameter D of the second carrier belt 46. The upper portion of the fourth shaft 46*h* is inclined outward (rightward in FIG. 11(B)) at a position where the second carrier belt 46 is bent. Thus, under the condition that the second carrier belt 46 is in contact with an inclined surface of the fourth pulley 46*d* as shown in FIG. 11(A), the bottom surface thereof is brought into contact with a surface of a coin C as shown in FIG. 11(B).

According to the above structure of the fourth pulley 46*d*, the annular inclined surface of the fourth pulley 46*d* brought into contact with the second carrier belt 46 allows the second carrier belt 46 which is reliably supported by the fourth pulley 46*d*, to be brought into contact with a coin C.

Further, in this embodiment, the transfer speed of a coin C transferred along with the circulation of the second carrier belt is set at a value slightly greater than the circumferential speed of the speed-reducing roller 46 and less than the transfer speed of a coin C moved along the first coin passage 31. Thus, a coin C passing through the speed-reducing roller 45 has a slight distance relative to each of preceding and subsequent coins C.

As shown in FIG. 10, the coin sort section 50 comprises a first sorting hole 51 formed in the base plate 41*a* at a position corresponding to the downstream end of the upstream straight passage 42*a*, and on the right side of the second linear portion 43*c* of the first positioning convex strip 43, and an elongated sorting hole 52 formed in the base plate 41*a* at a position corresponding to the coin sort passage 42*c*.

In this embodiment, the first sorting hole 51 is provided as a means to sort out a 1-yen coin from other types of coins. The width dimension of the first sorting hole 51 is set at a value slightly greater than the diameter of a 1-yen coin and less than the diameter of a 50-yen coin, and the length dimension thereof is set at a value greater than the diameter of the 1-yen coin. A first support marginal portion 51*a* having a width dimension of about 0.5 mm is formed between the second linear portion 43*c* of the first positioning convex strip 43 and the left edge of the first sorting hole 51 to support the edge of any type of coin C other than the 1-yen coin.

Thus, when any type of coin C other than the 1-yen coin passes through the upstream straight passage 42*a*, the left edge thereof is supported by the first support marginal portion 51*a*, and simultaneously the right edge thereof is supported by the right marginal portion of the first sorting hole 51. Thus, the coin other than the 1-yen coin passes through the upstream straight passage 42*a* without falling into the first sorting hole 51. In contrast, when the 1-yen coin passes through the upstream straight passage 42*a*, the left edge thereof is supported by the first support marginal portion 51*a*, but the right edge thereof is not supported by the right marginal portion of the first sorting hole 51. The 1-yen coin falls into the first sorting hole 51. In this way, various types of coins can pass through the upstream straight passage 42 to sort out 1-yen coins other types of coins.

In this embodiment, the elongated sorting hole 52 is provided as a means to sort out coins C other than 1-yen coins. The elongated sorting hole 52 consists of: a second sorting hole 53 having a width dimension greater than the diameter of a 50-yen coin and less than the diameter of a 5-yen coin; a third sorting hole 54 having a width dimension greater than the diameter of the 5-yen coin and less than the diameter of a 100-yen coin; a fourth sorting hole 55 having a width dimension greater than the diameter of the 100-yen coin and less than the diameter of a 10-yen coin; a fifth sorting hole 56 having a width dimension greater than the diameter of the 10-yen coin and less than the diameter of a 500-yen coin; and a sixth sorting hole 57 having a width dimension greater than the diameter of the 500-yen coin. These second to sixth sorting holes 53 to 57 are continuously formed in the width direction to define the elongated sorting hole 52.

A second support marginal portion 52*a* having a width dimension of 0.5 mm or less is formed between the rearward (upward in the drawing sheet of FIG. 10) edge of the elongated sorting hole 52 and the convex strip body 44*a* of the second positioning convex strip 44 to marginally support the edge of a coin C.

According to the above structure of the coin sorting section 50, the speed of a coin C fed from the first coin passage 31 is reduced at a given value by the speed-reducing roller 45. Then, the coin C is positioned by the first positioning convex strip 43 in such a manner as to allow the left edge thereof to be moved along the first positioning convex strip 43, and the positioned coin C is fed to the second carrier belt 46 approximately at the intermediate position of the upstream straight passage 42*a*.

The coin C fed to the second carrier belt 46 is slidingly moved ahead on the second coin passage 42 by the circulation and pressing of the second carrier belt 46. Then, the coin C firstly reaches the first sorting hole 51. When the coin C reaches the first sorting hole 51, the left edge thereof is in contact with the second linear portion 43*c*, and thereby supported by the first support marginal portion 51*a*. In this state, if the coin C is the 1-yen coin, it will fall downward through the first sorting hole 51 because the right edge of the 1-yen coin is not supported by the right marginal portion of the first sorting hole 51. If the coin C is any coin other than the 1-yen coin, the right edge thereof will be supported by the right marginal portion of the first sorting hole 51, and thereby can be moved ahead after passing through the first sorting hole 51.

Then, the coin C other than the 1-yen coin after passing through the first sorting hole 51 is moved into the curved passage 42*b* along with the circulation of the second carrier belt 46. Even though the second carrier belt 46 is bent leftward, the coin C goes straight ahead to collide with the arc-shaped edge 44*c* of the arc-shaped convex strip 44*b*, and then turned counterclockwise while being guided by the arc-shaped edge 44*c*. Subsequently, the coin C will be moved ahead on the coin sort passage 42*c* in the positioned state in which the right edge thereof (rear edge under the definition of the (−Y)-(+Y) direction) is supported by the second support marginal portion 52*a*.

Then, the coin C will fall down from the second sorting hole 53 if it is the 50-yen coin, or from the third sorting hole 54 if it is the 5-yen coin, or from the fourth sorting hole 55 if it is the 100-yen coin, or from the fifth sorting hole 56 if it is the 10-yen coin, or from the sixth sorting hole 57 if it is the 500-yen coin.

Figure 12:
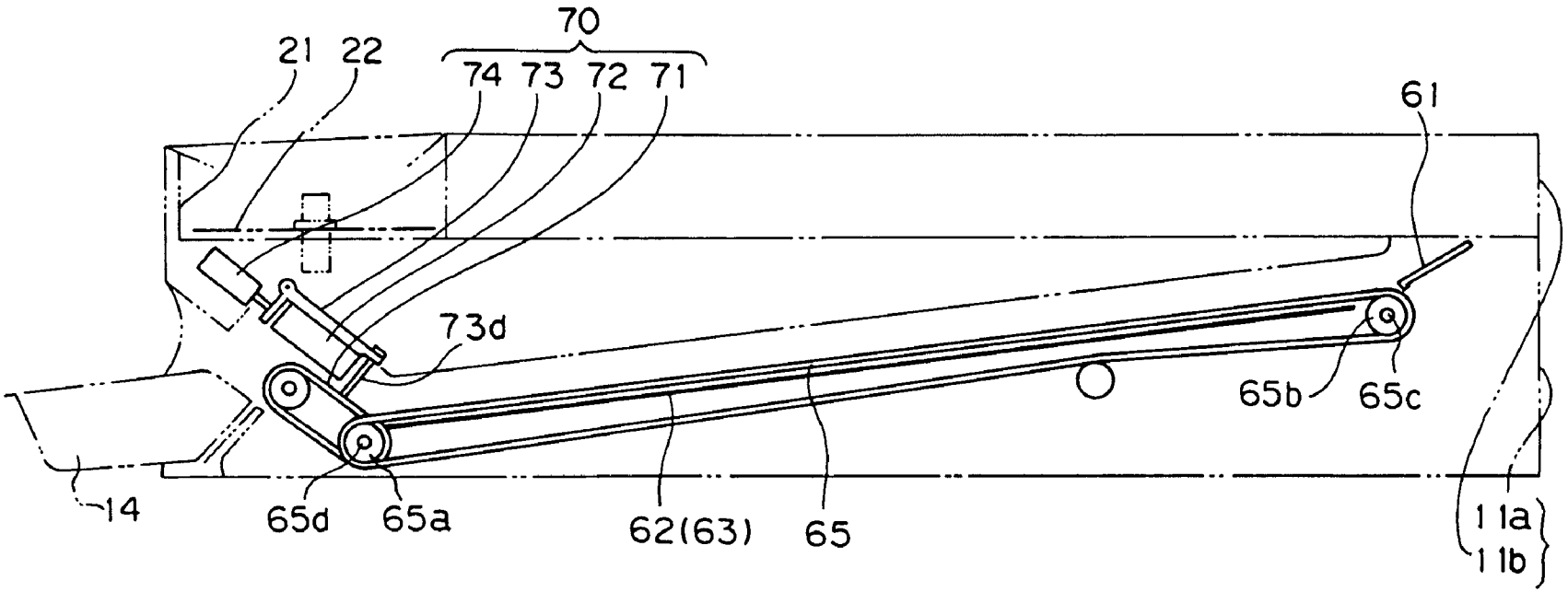
FIG. 12 is a sectional side view of a coin storage section illustrated in FIG. 6.
Figure 13:
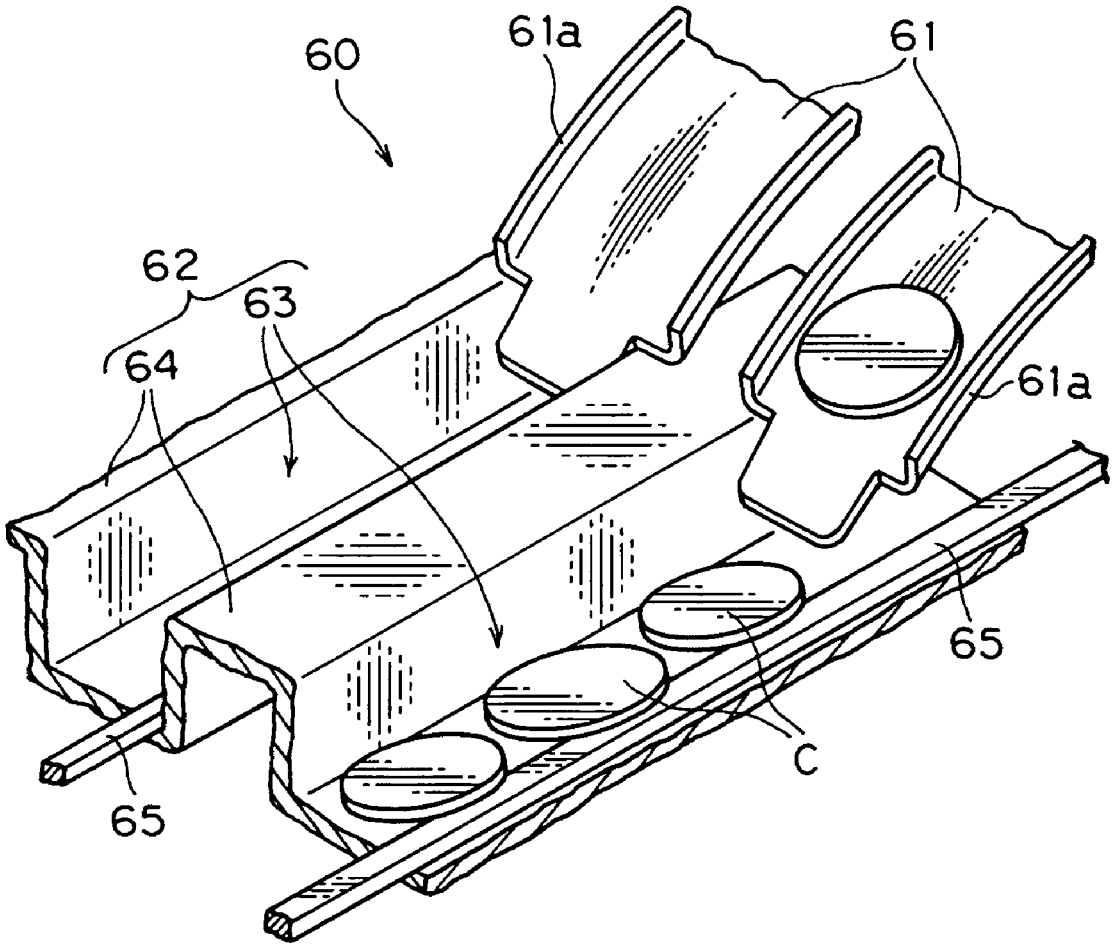
FIG. 13 is an enlarged fragmentary perspective view of the coin storage section illustrated in FIG. 6.

With reference to FIG. 12 and the foregoing FIGS. 5 and 6, the coin storage section 60 will be described below. FIG. 12 is a sectional side view of the coin storage section 60 illustrated in FIG. 6, and FIG. 13 is a fragmentary enlarged view of the coin storage section 60 illustrated in FIG. 12. As shown in FIGS. 5 and 6, the coin storage section 60 comprises a plurality (six in this embodiment) of slide plates 61 disposed corresponding, respectively to and just below the first sorting hole 51 and the second to sixth sorting holes 53 to 57 of the coin sort section 50, a coin storage plate 62 disposed corresponding to these slide plates 61, and a stacking belt 65 for forcibly moving coins C stored in the coin storage plate 62 to press them toward downstream.

As shown in FIG. 6 or 13, each of the slide plates 61 is designed to receive a coin C falling down through a corresponding one of the sorting holes 51, 53 to 57 and guide it to the coin storage plate 62. The slide plate 61 has width-directionally opposite sides each formed with an edge sheathing 61*a* having a height slightly greater than the thickness of the coin C to allow the received coin C to be smoothly guided toward the coin storage plate 62.

As shown in FIG. 5 or 12, the coin storage plate 62 is disposed within the basic frame 11*a* to be inclined from the rearward to frontward side. The coin storage plate 62 is formed as a corrugated plate having a plurality of concave portions formed corresponding to the respective slide plates 61 to extend in the longitudinal direction, so that a plurality of coin storage grooves 63 are defined by the respective concave portions, and a plurality of partition convex strips 64 each extending in the longitudinal direction are formed between the coin storage grooves 63.

The number of the coin storage grooves 63 is set at 6 corresponding to the first to sixth sorting holes 51, 53 to 57. These six coin storage grooves 63 serves as a storage hopper according to the present invention. Thus, different types of coins are stored in the grooves corresponding to the first to sixth sorting holes 51, 53 to 57, respectively.

The stacking belt 65 is set to have a width dimension less than a radius of the smallest coin C, and disposed along the right side of the base of each of the coin storage grooves 63 in a sliding contact manner. This stacking belt 65 is tensionally wound around between a frontward pulley 65*a* and a rearward pulley 65*b*, as shown in FIG. 12. The rearward pulley 65*b* is designed to receive a driving force of the second motor 34 through the second reduction gear train 35 (see FIGS. 3 and 10), the third reduction gear train 47 (see FIG. 10), and a rearward driving shaft 65*c* supporting the rearward pulley 65*b* to rotate the rearward pulley 65*b* together therewith. The frontward pulley 65*a* is designed to be rotated together with and around a frontward driven shaft 65*d*.

Thus, under the condition that the stacking belt 65 is circulated between the frontward pulley 65*a* and the rearward pulley 65*b* according to the driving of the second motor 34, the left edge of a coin C introduced into one of the coin storage grooves 63 is in contact with the base of the coin storage groove 63, and thereby the coin C is moved ahead while being rotated clockwise.

As shown in FIGS. 6 and 12, the coin ejection section 70 comprises an ejection belt 71 disposed obliquely opposed to the coin storage plate 62 at its downstream end, a coin presser member 72 disposed under the frontward region of the openable frame 11*b* and obliquely opposed to a corresponding one of the ejection belts 71, a stopper member (ejection control member) 73 for stopping the ejection of a coin C, and a solenoid device 74. A coin C ejected by the driving of the ejection belt 71 is discharged toward the coin tray 14 attached to the front end wall of the basic frame 11*a*.

FIG. 14 is an explanatory side view of the coin ejection section 70, wherein (A) shows the state after the stopper member 73 is set at a stop position, and (B) shows the state after the stopper member 73 is set at a stop-release position. As shown in this figure, the ejection belt 71 is tensionally wound around between a lower ejection pulley 71*a* attached to the frontward driven shaft 65*d* to be rotated together with the frontward driven shaft 65*d*, and an upper ejection pulley 71*b* disposed at a position facing a rear portion of the coin tray 14. Thus, the ejection belt 71 is inclined upward in the frontward direction. In this embodiment, this inclination is set at about 40° relative to the base plate of the basic frame 11*a*.

The base 63*g* of the coin storage groove 63 has a front end disposed in opposed relation to a portion of the surface of the ejection belt 71 which is wound around the lower ejection pulley 71*a*, through a small gap therebetween.

The coin presser member 72 is provided as a means to press a coin C to be ejected from the coin storage groove 63 according to the circulation of the ejection belt 71, so as to provide a stable ejection process. The coin presser member 72 is formed of a rectangular parallelepiped-shaped box member. This coin presser member 72 is disposed in opposed relation to the ejection belt 71 with a given gap left therebetween, at a position located slightly upward relative to the intermediate position of the forwarding portion of the ejection belt 71. Further, the coin presser member 72 has a base plate 72*a* formed with a through-hole 72*b*, and a steel ball 72*c* fitted in the through-hole 72*a* in such a manner that a part of the peripheral surface of the steel ball 72*c* protrudes from the through-hole 72*a*.

Figure 14A:
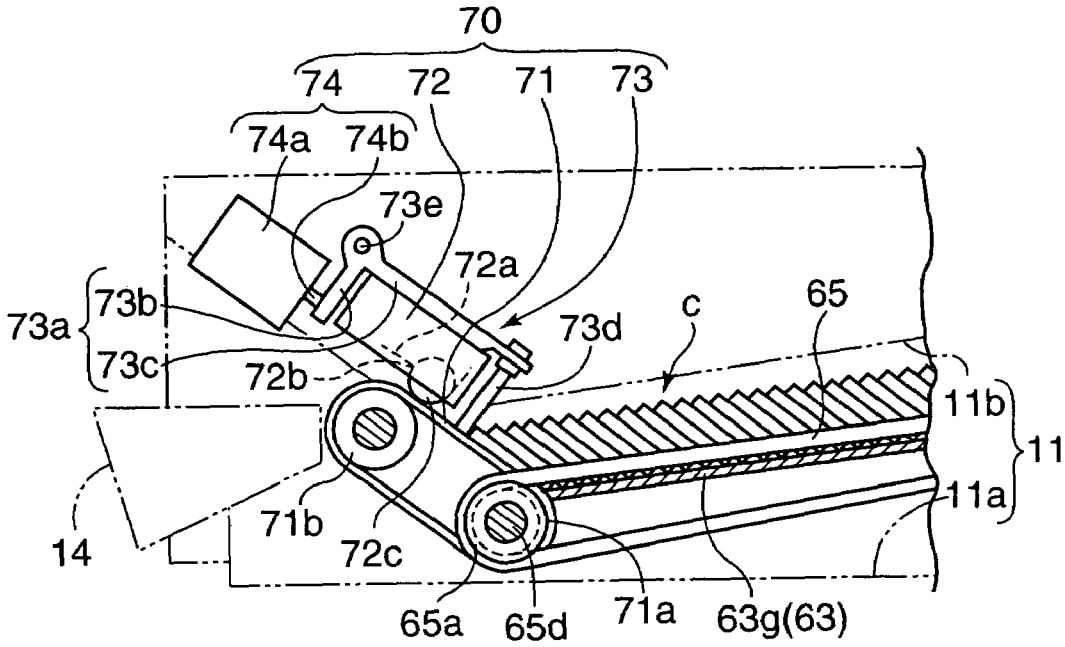
FIG. 14 is an explanatory side view of a coin ejection section, wherein (A) shows the state after a stopper member is set at a stop position, and (B) shows the state after the stopper member is set at a stop-release position.
Figure 14B:
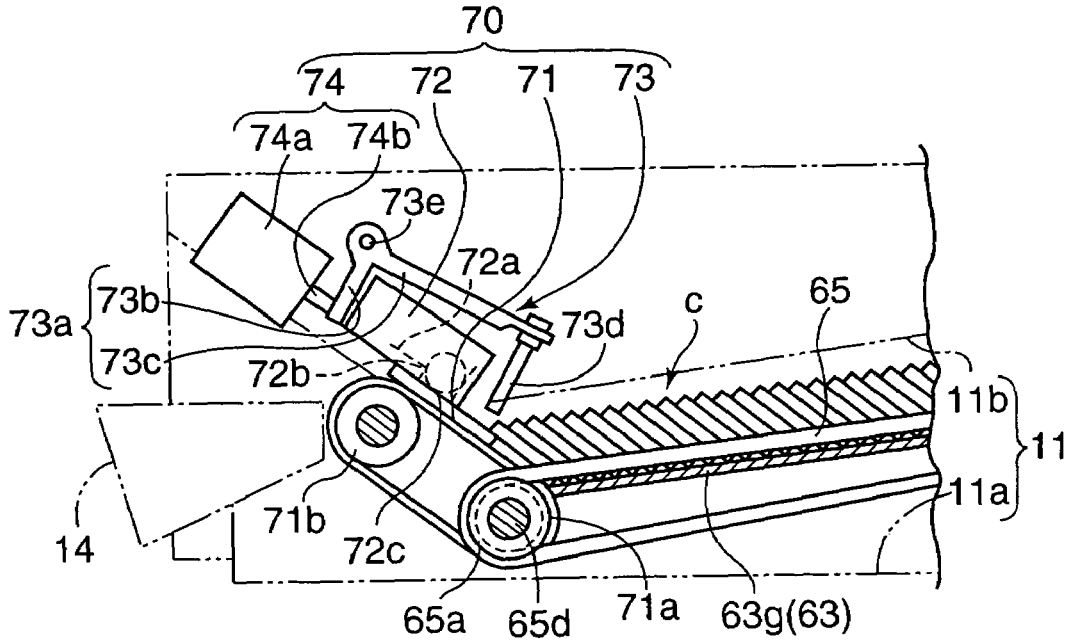

The steel ball 72*c* serves as a weight for pressing the top surface of a coin C which is being ejected by the ejecting belt 71, as shown in FIG. 14(B), to give a frictional force between the back surface of the coin C and the top surface of the ejection belt 71 so as to prevent slip therebetween. This makes it possible to provide a further stable ejection process.

The stopper member 73 comprises an L-shaped operation rod 73*a* consisting of a first operation arm 73*b* and a second operation arm 73*c*, and a stopper pin 73*d* attached to the tip of the second operation arm 73*c* in such a manner as to be located in opposed relation to the first operation arm 73*b*.

The stopper member 73 is designed such that, the connection portion between the first operation arm 73*b* and the second operation arm 73*c* is pivotally supported by a support shaft 73*e* in a swingable manner about the support shaft 73*e*, in the state when the coin presser member 72 is held between the first operation arm 73*b* and the stopper pin 73*d*, so as to move the stopper member 73 between a stop position where the tip of the stopper pin 73*d* is in contact with the front edge of a coin C on the ejection belt 71 to stop the movement of the coin C so as to prevent the ejection of the coin C, as shown in FIG. 14(A), and a stop-release position where the contact/stopping is released, as shown in FIG. 14(B).

Further, the stopper pin 73*d* has a weight arranged to generate a given moment acting on the stopper member 73 in the clockwise direction around the support shaft 73*e*, so that the stopper member 73 is normally set at the stop position.

The solenoid device 74 comprises a solenoid body 74*a* adapted to turn on/off the generation of a magnetic force in response to an on/off operation of power supply, and a core 74*b* received in the solenoid body 74*a* in a protrudable manner. The solenoid body 74*a* is designed such that the tip of the core 74*b* in its retracted position is in contact with the lower end of the first operation arm 73*b* set at the stop position, and the tip of the core 74*b* in its protruded position presses the first operation arm 73*b* to move the stopper member to the stop-release position.

According to the coin ejection section 70 constructed as above, when a first one of coins C transferred while being rotated on the base plate 63*g* of the coin storage groove 63 in conjunction with the circulation of the stacking belt 65 reaches the ejection belt 71, the leading edge of the coin C is moved upward by the ejection belt 71 to come in close contact with the top surface of the ejection belt 72. Then, the leading edge in the above state is brought into contact with and stopped by the stopper pin 73*d* of the stopper member 73, so that the coin C is kept in this position while sliding relative to the top surface of the ejection belt 71.

After the first coin C is stopped on the ejection belt 71, each leading edge of subsequent coins C is brought into contact with the top surface of the preceding coin C, and thereby the subsequent coins C are raised in turn. Thus, the plurality of coins C are stored in the coin storage groove 63 in an obliquely stacked manner, as shown in FIG. 14(A).

Then, when the solenoid body 74*a* is turned on, the core 74*b* is protruded from the solenoid body 74*a* to push the first operation arm 73*b*, so that the stopper member 73 is swung counterclockwise around the support shaft 73*e*, and the tip of the stopper pin 73*d* is moved away from the top surface of the ejection belt 71 in conjunction with the swing movement.

Thus, the coin C at the uppermost stream position in the coin storage groove 63 is moved ahead obliquely upward according to the circulation of the ejection belt 71, and ejected toward the coin tray 14 through the gap between the ejection belt 71 and the coin presser member 72.

Figure 15:
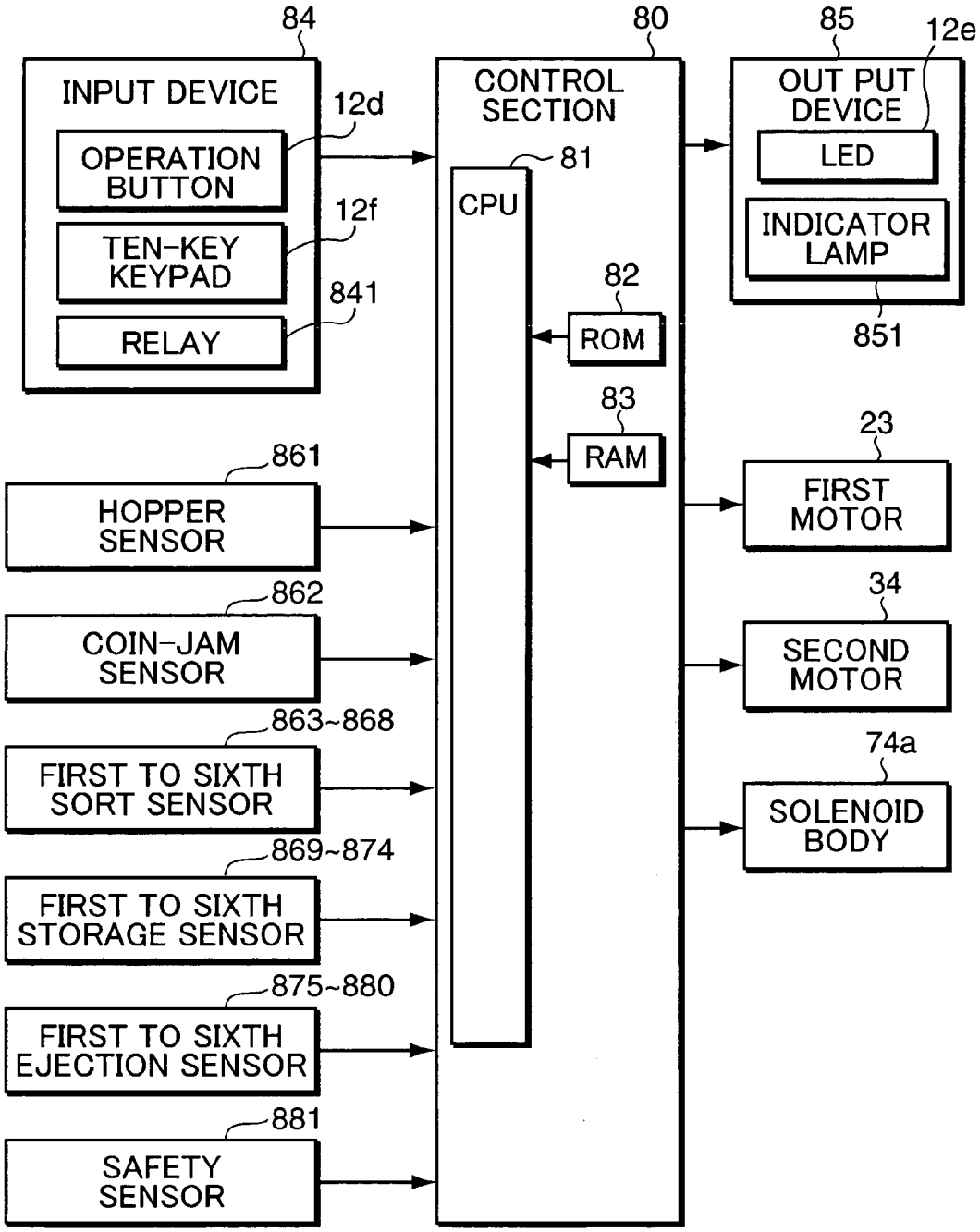
FIG. 15 is an explanatory block diagram of the control of the coin change dispenser according to a control section.

Then, immediately after the coin C is moved into the gap just under the stopper pin 73*d*, the stopper member 73 is returned to the stop position because the time-period for protruding the core 74*b* from the solenoid body 74*a* is set at a fairly small value, and thereby the tip of the stopper pin 73*d* is brought into contact with the top surface of the coin C which is being transferred by the ejection belt 71. Thus, the stopper pin 73*d* is returned to its original position immediately after the coin C is disengaged with the upstream edge of the stopper pin 73*d*, so that the stopper pin 73*d* prevents the ejection of a subsequent coin C until the core 74 is re-protruded FIG. 15 is an explanatory block diagram of the control of the coin change dispenser 10 according to the control section 80. As shown in this figure, the control section 80 is provided as a means to comprehensively control each operation of the coin change dispenser 10, and the so-called microcomputer is employed therein. The control section 80 comprises a central processing unit (CPU) 81, a read only memory (ROM) 82 as an external storage device storing control programs and others, and a random access memory (RAM) 83 as an external storage device for temporarily storing various data. The control section 80 is connected with an input device and an output device 85.

The input device 84 employed herein includes a relay 841 for relaying a signal from a base unit of the cash change dispenser, such as a cash registration device, in addition to the aforementioned operation buttons 12*d* and ten-key keypads 12*f*. The output device 85 employed therein includes various types of indicator lamps 851, in addition to the aforementioned 7-segment LED 12*e*.

A plurality of coin sensors are provided in various sections of the coin change dispenser 10 to detect coins C and send the obtained detection signals to the control section 80. As shown in FIG. 7, the coin sensors employed therein includes: a hopper sensor 861 for detecting the presence of a coin C in the input hopper 21; a coin-jam sensor 862 for detecting the jam of coins C in the first coin passage 31; a first sort sensor 863, a second sort sensor 864, a third sort sensor 865, a fourth sort sensor 866, a fifth sort sensor 867 and a sixth sort sensor 868 for detecting different types of coins C sorted out using the first to sixth sorting holes 51, 53, 54, 55, 56, 57, respectively; a first storage sensor 869, a second storage sensor 870, a third storage sensor 871, a fourth storage sensor 872 a fifth storage sensor 873 and a sixth storage sensor 874 for detecting storage statuses in the coin storage grooves 63 corresponding to the first to sixth sorting holes 51, 53 to 57, respectively; and a first ejection sensor 875, a second ejection sensor 876, a third ejection sensor 877, a fourth ejection sensor 878, a fifth ejection sensor 879 and a sixth ejection sensor 880 provided corresponding to the first to sixth storage sensors 869 to 874 and disposed adjacent, respectively, to the ejection belts 71 in the coin ejection section 70.

Further, a safety sensor 881 is disposed in the inner portion of the coin tray 14 to detect the insertion of user's hand thereinto. This, safety sensor 881 is provided as a means to prevent a user from reaching the circulating ejection belts 71 to ensure user's safety.

In this embodiment, the coin change dispenser 10 is designed such that an appropriate control signal is output from the CPU 81 to the first motor 23, the second motor 34 or the solenoid body 74*a* in accordance with an input signal from the input device 84 and a detection signal from various sensors, so as to drive the first motor 23, the second motor 34 and the solenoid body 74*a* in accordance with the control signal to achieve an adequate operation.

More specifically, the control section 80 is operable to control a coin input operation for putting a number of coins C as a mixture of various types of coins in the input hopper 21 and storing these coins C on a coin type by type basis, and a change ejection operation for ejecting a given amount of change from the coins C stored in the coin storage section 60, so as to operate the coin change dispenser 10. In an operation mode for performing the coin input operation, after turning on the power switch 12*g* (see FIG. 1), one or more of the operation button 12*d* for designating the coin input mode are manually pushed, and a plurality of coins C is continuously put in the input hopper 21. In response to this operation, the hopper sensor 861 detects that the coins C exist in the input hopper 21, and the obtained detection signal is sent to the control section 80. Then, the control section 80 outputs a drive signal to the first motor 23 and the second motor 34. According to the driving of the first motor 23 and the second motor 34 based on the drive signal, the rotary tray 22 is rotated around the center shaft 22*a*, and the first carrier belt 32, the second carrier belt 46 and the stacking belt 65 are circulatingly moved.

Then, the coin C fed from the feed hole 21*a* of the input hopper 21 to the first coin passage 31 according to the rotation of the rotary tray 22 is transferred toward the second transfer section 40 by means of the guide based on the circulation of the first carrier belt 32. During this process, if a coin-jam signal is generated by the coin-jam sensor 862, the control section 80 will output a stop signal to the first motor 23 and the second motor 34 to stop these motors, and thereby the operation will be discontinued. In the event of occurrence of such a discontinuation, the passage lid member 36 is opened to check the first coin passage 31. After solving the coin jam, the operation will be re-started.

Then, the coin C reaching the second coin passage 42 falls down from either one of the sorting holes 51, 53 to 57 during the course of transfer in the second coin passage 42. Either one of the first to six sorting sensors 863 to 868 detects from which of the sorting holes 51, 53 to 57 the coin C has fallen down. Based on the obtained detection signal, the CPU 81 counts the number of coins on a coin type by type basis. Just after the sorting for the entire coins C in the input hopper 21 is completed, the number of each type of coins C is stored in the RAM 83.

Then, the coins C fed to the coin storage section 60 as the result of falling from either one of the sorting holes 51, 53 to 57 are transferred within the corresponding coin storage grooves 63 toward the coin ejection section 70 by means of the guide based on the circulation of the stacking belt 65, and obliquely stacked in turn. During this transfer, if the amount of coins in either one of the coin storage grooves 63 exceeds a predetermined allowable value, this defect will be detected by either one of the first to sixth storage sensors 869 to 874, and the first motor 23 and the second motor 34 will be stopped according to a stop signal generated from the CPU 80 in response to the detection of the defect. This operation result will be output from the output device to allow a given action to be made.

When the amount of coins fed in each of the coin storage grooves 63 does not exceed the allowable value, the operation is continued until the hopper sensor 861 detects that the input hopper 21 becomes empty. Then, in response to detecting the empty state of the input hopper 21 by the hopper sensor 861, a timer (not shown) is activated, and, after a lapse of a predetermined time set in the timer, the first motor 23 and the second motor 34 are stopped to complete the operation in the coin input mode In the change ejection mode, a signal for designating this mode is entered from the input device 84. In response to the signal, the coin change dispenser 10 is arranged set in a mode for receiving a signal from the cash registration device (not shown) through the relay 841. Then, when a signal requesting for ejecting a given amount of change is entered from the cash registration device, the CPU 81 calculates the number of each type of coins C corresponding to the amount of requested change, and sends a signal corresponding to the calculated numbers to one or more of the solenoid bodies 74*a* associated with the corresponding coin storage grooves 63 storing the target types of coins.

Thus, in each of the solenoid devices 74, the solenoid body 74*a* is magnetized to hold the tip of the stopper pin 73*d* at a position where it is spaced apart from the stacking belt 71. Then, after a given number of coins C is ejected, the solenoid body 74*a* is demagnetized to return the stopper pin 73*d* to its original position. In this manner, according to the circulation of the ejection belt 71, each type of coins C stored in the coin storage groove 63 are ejected to the coin tray 14 in the calculated number The number of ejected coins is sequentially detected by each of the first to sixth ejection sensors 875 to 880, and stored in the RAM 83. Thus, based on the stored data in the PAM 83 and the initial sum of coins in the coin storage section 60 during the coin input mode, each amount of input coins and ejected coins, and the number of remaining coins can be checked. The value of the remaining coins is displayed on the 7-segment LED 12*e*. Further, a plurality of LEDs for displaying respective remaining amounts of various types of coins may be provided, and each of the remaining amounts may be displayed by means of lighting of the LEDs.

As mentioned above in detail, this embodiment is based on a coin change dispenser 10 designed to sequentially extract from an input hopper 21 plural types of coins C put in the input hopper, to sort the extracted coins C into their coin types, to store the sorted coins C in a coin storage section 60 on a coin type by type basis, and to eject a necessary amount of coins C from the coin storage section 60 on a coin type by type basis in response to a request. The coin change dispenser 10 comprises: a coin sort section 50 for sorting the coins C discharged from the input hopper 21; and a coin storage section 60 for storing the coins sorted by the coin sort section 50. The coin storage section 60 includes a plurality of coin storage grooves 63 provided respectively to the plural coin types and disposed parallel to each other. Each of the coin storage grooves has a width dimension slightly greater than the diameter of a corresponding one of the types of coins C and extending approximately horizontally. The coin storage section 60 further includes a stacking belt 65 disposed along the base of each of the coin storage grooves 63 to extend in the longitudinal direction, and a stopper member 73 adapted to be moved between an operation position of allowing the coin C located at the downstream end of each of the coin storage grooves 63 to pass therethrough, and a non-operation position preventing the ejection of the downstream-end coin C so as to allow the subsequent coins C to be stacked on each other. Coins C sorted out in the coin sort section 50 are introduced into a corresponding one of the coin storage grooves 63 of the coin storage section 60, and transferred toward downstream according to the circulation of the stacking belt 65 disposed along the base of the coin storage groove 63. Then, when a leading one of the coins C reaches the stop member 73 disposed at the downstream end of the coin storage groove 63 and set at a stack position, the stopper member 73 prevents the transfer of the leading coin C, and moves the leading coin C to a stackable position. Thus, the subsequent coin C is guided in such a manner as to get on the top surface of the leading coin C set at the stackable position, and stacked on the leading coin C in a posture where its top edge is inclined frontward to lean on the top surface of the leading coin C, so-called "lying stack". This stacking operation will be repeated in subsequent coins C to allow the coins C to be sequentially stacked on each other approximately in a vertical posture within each of the coin storage grooves 63.

When it is necessary to eject the coins C stored in a vertical posture within each of the coin change grooves, the stopper member 73 is moved to a coin-passing enabling position. Thus, the coins C are ejected outside through the stopper member 73 set at the coin-passing enabling position.

As above, the stopper member 73 disposed at the downstream end of each of the coin storage grooves 63 can be set at the stack position of allowing the coins to be stacked on each other in a vertical posture so as to eliminate conventional problems, such as the need for placing a coin storage hopper in a vertical posture to facilitate downsizing of the coin change dispenser 10.

In addition, the stacking belt 65 is disposed along one side of the base of each of the coin storage grooves 63. In this case, when a coin C is moved ahead in conjunction with the movement of the stacking belt 65 disposed along one side of the base of one of the coin storage groove 63, a turning force is given to the coin C, because one of the edges of the coin C on the side of the stacking belt is moved ahead and simultaneously the other or opposite edge is in contact with the base of the coin storage groove. Thus, the coin C will be moved ahead while being rotated. This allows adjacent coins C having peripheral edges in contact with one another to have a repulsive interaction therebetween, so that the coins C are smoothly transferred all the time without the occurrence of problems, such as coin jam in the passage.

Further, the coin ejection section 70 includes the ejection belt 71 having a carrying surface inclined upward toward downstream, and a lower end facing the base of each of the coin storage grooves 63, and the stopper member 73 having the stopper pin 73*d* adapted to be moved to get close to and away from the carrying surface of the ejection belt 71. In this case, when the stopper pin 73*a* of the stopper member 73 is in contact with the top surface of the circulatingly moving ejection belt 74, a leading coin C transferred toward downstream within one of the coin storage grooves 63 in conjunction with the circulation of the stacking belt 63 is guided and pulled up by the ejection belt 71, and then butted against and stopped by the stopper pin 73*d* to restrict any further movement thereof. Thus, the leading edge of a subsequently transferred coin C is moved to get on the top surface of the leading coin C. Further, the subsequent coin C has a frontward force given by the circulation of the stacking belt 65, and a rotational movement. Thus, the front edge of the subsequent coin C is brought into contact with the convex portion of the top surface of the leading coin C, and moved ahead to get on the convex portion of the top surface of the leading coin C, so that the subsequent coin C is stacked on the leading coin. This operation will be repeated between a succeeding coin C and a preceding coin C so as to sequentially stack coins transferred within the coin storage grooves 63.

Then, when it is necessary to eject one or more coins C stored within the coin storage groove 63 in the stacked state, the stopper pin 73*d* of the stopper member is moved to get away from the top surface of the ejection belt 71. Thus, the restriction imposed by the stopper pin 73*d* on the movement of the coins C is released, and thereby the coins can be transferred in conjunction with the circulation of the ejection belt 71, and finally ejected outside.

The stopper member 73 including the stopper pin 73*d* adjacent to the ejection belt 71 makes it possible to control the storing operation of coins C and the ejecting operation of stored coins only by varying the distance between the stopper pin 73*d* and the ejection belt 71 under the condition that both the stacking belt 65 and the ejection belt 71 are continuously driven. Thus, the structure for controlling the storage and ejection of coins C can be simplified.

Further, the coin change dispenser 10 according to the above embodiment is based on the structure designed to sequentially extract from an input hopper plural types of coins C put in the input hopper, to sort the extracted coins C into their coin types, to store the sorted coins C in a coin storage section 60 on a coin type by type basis, and to eject a necessary amount of coins C from the coin storage section 60 on a coin type by type basis in response to a request. The coin change dispenser 10 comprises: a first transfer section 30 for discharging the input coins C from the input hopper 21 in a line and in a horizontal posture; a second transfer section 40 for further transferring the coin C fed from the downstream end of the first transfer section 30; and a coin sort section 50 for sorting the coins during the course of the transfer in the second transfer section and feeding the sorted coins to the coin storage portion 60 on a coin type by type basis. The second transfer section 40 is set to have a coin-transfer speed less than that of the first transfer section 30. Thus, coins C extracted from the input hopper 21 and transferred by the first transfer section 30 is restricted in transfer speed, so that a subsequent coin is brought into contact with a preceding coin, and thereby the aligned coins C in the first transfer section 30 is slippingly moved ahead while being brought into contact with each other. Then, in the second transfer section 40, the coins C are transferred at a speed less than that of the first transfer section 30. Thus, the sorting operation in the coin sort section 50 to be performed along with transfer can be accurately performed to provide enhanced accuracy in sorting the coin C.

In addition, the transfer speed of the second transfer section 40 less than that of the first transfer section 30 makes it possible to maintain the same feed timing from the first transfer section 30 to the second transfer section 40. Further, even if preceding and subsequent coins C are alighted while being brought into contact with one another in the second transfer section 40, the transfer speed of the second transfer section 40 set at a lower value can prevent the occurrence of a problem about erroneous sorting due to the contact, Further, the speed-reducing roller 45 interposed between the first transfer section 30 and the second transfer section 40 and set to have a circumferential speed equal to the coin-transfer speed of at least the second transfer section 40 allows coins C discharged from the downstream end of the first transfer section 30 to be reduced in transfer speed to that of the second transfer section 40 and then fed to the second transfer section 40. Thus, as compared to the cases where the coins C are fed directly to the second transfer section 40 from the first transfer section 30, the coins can be stably fed to the second transfer section 40 to prevent the occurrence of a trouble such that the coins C are superimposed on each other on a second transfer roller to cause difficulties in sorting the coins C.

In particular, the second transfer section 40 may be set to have a coin-transfer speed greater than the circumferential speed of the speed-reducing roller 45 to allow the speed of coins C reduced by the speed-reducing roller 45 to be slightly increased by the second transfer section 40. Thus, in the second transfer section 40, adjacent coins C can have a distance therebetween, so that the interference between preceding and subsequent ones of the coins C during the course of transfer in the second transfer section 40 can be avoided to provide reliable sorting.

The above embodiment further includes a groove-shaped first coin passage 31 for slidingly moving coins C toward downstream while restricting the movement in the width direction, a first carrier belt 32 disposed along one side of the passage surface of the first coin passage 31 to extend in the coin-transfer direction, and a passage lid member 36 for covering over the first coin passage 31 while being slightly spaced apart from the coins C. In addition, the first carrier belt 32 has a narrowed width dimension to prevent the center region of a coin C from being placed thereon. In this case, when a coin C is moved ahead on the transfer surface of the first coin passage 31 according to the driving of the first carrier belt 32 disposed along one side of the transfer surface, a turning force is given to the coin C, because one of the edges of the coin C on the side of the carrier belt is moved ahead and simultaneously the other or opposite edge is in contact with the transfer surface. Thus, the coin C will be moved ahead while being rotated, so that the coins C are smoothly transferred all the time without the occurrence of problems, such as coin jam in the passage.

The above embodiment further includes: a second coin passage 42 for slidingly moving a coin C toward downstream while restricting the movement in the width direction; a second carrier belt 46 disposed to extend in the coin-transfer direction while being in contact with the center region of the top surface of the coin C, and adapted to be driven by driving means so as to transfer the coin C along the second coin passage 42 toward downstream while pressing the coins C from above according to the circulation thereof based on the driving. Further, the second coin passage 42 has a curved passage 42*b* for turning the transfer direction of the coin C approximately perpendicularly, and a coin sort passage 42*c* extending from the curved passage 42*b* and having a passage surface formed with a plurality of sorting holes. The curved passage 42*b* has an arc-shaped outer edge 44*c* for preventing the coin C from jumping out therefrom, and the coin sort passage 42*c* is formed with a linear sheathing portion (a concave strip body 44*a* of a second-positioning concave strip 44) continuing to the arc-shaped outer edge 44*c*. Thus, when a coin C transferred on the second transfer passage according to the circulation of the second carrier belt 46 and the pressing of the second carrier belt 46 against the top surface thereof reaches the curved passage 42*b*, the coin C is firstly brought into contact with the arc-shaped outer edge 44*c* according to a centrifugal force, and guided by arc-shaped outer edge 44*c* to change the transfer direction at approximately 90-degree. During this process, the coin C is moved to the coin sort passage 42*c* while maintaining the contact between the coin C and the arc-shaped outer edge 44*c* by a centrifugal force. That is, the coin C is brought into contact with the front edge of the convex strip body 44*a* having a peripheral edge continuing from the arc-shaped outer edge 44*c*, and transferred along a positioned path. Thus, coins C can be adequately sorted in an elongated sorting hole 52.

The present invention is not limited to the above embodiment, but includes the following content.

(1) In the above embodiment, the ejection belt 71 and the stacking belt 65 are connected with one another in such a manner that they are simultaneously circulated through the frontward pulley 65*a*. Alternatively, these may be independently driven by obtaining a driving force from individual driving sources. This makes it possible to stop the ejection belt 71 when coins C are stacked in the coin storage grooves 63 and drive the ejection belt 71 when the coins C is ejected, so as to facilitate space-saving about the stop member 73 and the solenoid member 74. This also makes it possible to simplify the structure of the coin ejection section having only a narrow utilizable space in the coin change dispenser 10, and facilitate maintenance thereof.

(2) In the above embodiment, the coin tray 14 is fixed to the lower region of the front surface of the basic frame 11*a*. Alternatively, the coin tray 14 may be detachably attached to the lower region of the front surface of the basic frame 11*a*. The detachably structure of the coin tray 14 may include a magnet provided at the back surface of the coin tray 14; and a combination of an engagement protrusion provided on a counter surface of the basic frame 11*a*, and engagement holes formed in the back surface of the coin tray 14 and designed to have dimensions corresponding to the engagement protrusion. The coin tray 14 detachably attached to the basic frame 11*a* can be detached from the basic frame when a change is ejected to the coin tray 14 to conveniently to use directly as a tray for customers.

(3) While the first carrier belt 32 in the above embodiment is disposed in the first coin passage 31 to extend over the entire length in the transfer direction, the invention according to claim 1 is not limited to the first carrier belt 32 which is disposed along only one side of the first coin passage 31, but the first carrier belt 32 may be disposed along both sides of the first coin passage 31 or may be a wide belt covering over the entire surface of the first coin passage 31.

(4) In the above embodiment, the stacking belt 65 is disposed along one width-directional side of the base of the coin storage groove 63 to extend over the entire length in the longitudinal direction. Alternatively, the stacking belt 65 may be disposed along both width-directional side surfaces of the coin storage groove 63 or may be disposed along both width-directional sides of the base of the coin storage groove 63 or may be a wide belt covering over the entire base.

INDUSTRIAL APPLICABILITY

As mentioned above, the present invention relates to a coin change dispenser. In particular, the present invention is suitable for handling of plural type of coins.

The invention claimed is:

1. A coin change dispenser comprising:

an input hopper for receiving plural types of coins;

a sorter for sorting coins extracted from the input hopper into their coin types;

a storage device for storing the coins sorted by the sorter on a coin type by type basis, the storage device including:

a plurality of coin storage grooves provided respectively to the plural coin types and disposed parallel to each other, each of the coin storage grooves having a width dimension slightly greater than the diameter of a corresponding one of the types of coins and extending approximately horizontally;

a carrier belt disposed along a region of the base of each of the coin storage grooves to extend in the longitudinal direction of the coin storage grooves; and an ejector adapted to be moved between an operation position of allowing one or more of the coins to be ejected from the downstream end of each of the coin storage grooves, and a non-operation position of allowing the coins to be stacked on each other.

2. The coin change dispenser as defined in claim 1, wherein the carrier belt is disposed along one side of the base of each of the coin storage grooves.

3. The coin change dispenser as defined in claim 2, wherein the ejector includes:

an ejection belt having a carrying surface inclined upward toward downstream, and a lower end facing the base of each of the coin storage grooves; and an ejection control member having a stopper adapted to be moved to get close to and away from the carrying surface of the carrier belt.

4. The coin change dispenser as defined in claim 1, wherein the ejector includes:

an ejection belt having a carrying surface inclined upward toward downstream, and a lower end facing the base of each of the coin storage grooves; and an ejection control member having a stopper adapted to be moved to get close to and away from the carrying surface of the carrier belt.

* * * * *